US006692825B2

(12) United States Patent
Qin et al.

(10) Patent No.: US 6,692,825 B2
(45) Date of Patent: Feb. 17, 2004

(54) SYNTHETIC FIBER NONWOVEN WEB AND METHOD

(75) Inventors: Jian Qin, Appleton, WI (US); Yong Li, Appleton, WI (US); Wendy Lynn Van Dyke, Neenah, WI (US); Anthony John Wisneski, Kimberly, WI (US); Palani Raj Ramaswami Wallajapet, Wauwatosa, WI (US); Hannong Rhim, Roswell, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 8 days.

(21) Appl. No.: 10/091,801

(22) Filed: Mar. 6, 2002

(65) Prior Publication Data

US 2002/0164914 A1 Nov. 7, 2002

Related U.S. Application Data

(62) Division of application No. 09/626,014, filed on Jul. 26, 2000, now Pat. No. 6,469,130.

(51) Int. Cl.[7] ..... B32B 3/00; B32B 27/00; B32B 5/02; D02F 3/00

(52) U.S. Cl. ..... 428/357; 428/364; 428/394; 428/395; 442/49; 442/50; 442/59; 442/62; 442/327; 442/333; 528/170; 528/310; 528/322; 525/408; 604/354; 604/365; 604/367; 604/372; 604/385.01; 604/385.02; 604/385.04; 604/385.06; 604/385.13; 604/385.17

(58) Field of Search ..... 428/357, 364, 428/394, 395; 442/49, 50, 59, 62, 327, 333; 528/170, 310, 322; 525/408; 604/354, 365, 367, 372, 385.01, 385.02, 385.04, 385.06, 385.13, 385.17

(56) References Cited

U.S. PATENT DOCUMENTS

| | | | | |
|---|---|---|---|---|
| 4,423,184 | A | 12/1983 | Kopolow et al. | 525/57 |
| 4,767,825 | A | 8/1988 | Pazos et al. | 525/408 |
| 4,855,179 | A | 8/1989 | Bourland et al. | 428/296 |
| 4,861,539 | A | 8/1989 | Allen et al. | 264/204 |
| 4,962,172 | A | 10/1990 | Allen et al. | 526/318.42 |
| 4,985,298 | A | 1/1991 | Buckley et al. | 428/288 |
| 5,047,456 | A | 9/1991 | Onwumere et al. | 524/13 |
| 5,066,742 | A | 11/1991 | Gupta | 526/216 |
| 5,079,080 | A | 1/1992 | Schwarz | 428/288 |
| 5,139,841 | A | 8/1992 | Makoui et al. | 428/109 |
| 5,147,956 | A | 9/1992 | Allen | 526/318.42 |
| 5,151,465 | A | 9/1992 | Le-Khac | 524/549 |
| 5,280,079 | A | 1/1994 | Allen et al. | 525/329.2 |
| H1298 | H | 4/1994 | Ahr et al. | 428/296 |
| 5,342,335 | A | 8/1994 | Rhim | 604/367 |
| 5,350,370 | A | 9/1994 | Jackson et al. | 604/367 |
| 5,577,494 | A | 11/1996 | Kuypers et al. | 128/201.13 |
| 6,010,586 | A | 1/2000 | Suprise | 156/73.1 |

FOREIGN PATENT DOCUMENTS

| | | | | |
|---|---|---|---|---|
| EP | 0 268 498 A2 | | 5/1988 | C08F/8/14 |
| EP | 0 414 541 A1 | | 2/1991 | D04H/1/70 |
| EP | 0 547 604 A1 | | 6/1993 | D04H/1/56 |
| EP | 0 656 077 B1 | | 6/1995 | D01F/6/36 |
| EP | 0 663 967 B1 | * | 7/1995 | |
| EP | 0 780 108 A1 | | 6/1997 | A61F/13/15 |
| WO | WO 93/12275 | | 6/1993 | D01F/11/02 |
| WO | WO 93/24684 | | 12/1993 | D01F/1/10 |
| WO | WO 95/08353 | | 3/1995 | A61L/15/60 |

* cited by examiner

*Primary Examiner*—P. Hampton-Hightower
(74) *Attorney, Agent, or Firm*—Patricia A. Charlier

(57) ABSTRACT

A nonwoven web and method of preparing a novel nonwoven web of synthetic fiber are disclosed. An aqueous solution amide crosslinked synthetic precursor polymer is extruded under defined conditions through a plurality of die orifices to form a plurality of threadlines. The threadlines are attenuated with a defined primary gaseous source to form fiber under conditions of controlled macro scale turbulence and under conditions sufficient to permit the viscosity of each threadline, as it leaves a die orifice and for a distance of no more than about 8 cm, to increase incrementally with increasing distance from the die, while substantially maintaining uniformity of viscosity in the radial direction, at a rate sufficient to provide fiber having the desired attenuation and mean fiber diameter without significant fiber breakage. The attenuated threadlines are dried with a defined secondary gaseous source. The resulting fibers are deposited randomly on a moving foraminous surface to form a substantially uniform web. The moving foraminous surface is positioned about 10 to about 100 cm from the last gaseous source to contact the threadlines. The fibers have a mean fiber diameter in the range of about 0.1 to 30 $\mu$m and are substantially free of shot. The attenuating and drying steps are carried out under conditions of controlled macro scale turbulence.

11 Claims, 8 Drawing Sheets

(a) steam/hot air = 0/100

(b) steam/hot air = 50/50

(c) steam/hot air = 80/20

Composite Permeability

SYNTHETIC FIBER NONWOVEN WEB AND METHOD

This patent applications is a Division of prior, U.S. patent application Ser. No. 09/626,014, filed Jul. 26, 2000 now U.S. Pat. No. 6,469,130.

BACKGROUND OF THE INVENTION

1. Technical Field

This invention relates to a nonwoven web of synthetic fiber. In one aspect, this invention relates to a nonwoven web of -absorbent fiber. In one aspect, this invention relates to a method of preparing a nonwoven web of superabsorbent fine synthetic fiber.

2. Background

Certain polymers are termed superabsorbent polymers for their ability to take up and hold fluids. Poly(acrylic acid) copolymer is one example of such a superabsorbent polymer.

Dry spinning can form superabsorbent polymer into continuous filaments. Dry spinning extrudes an aqueous solution of the polymer into air. Using a highly concentrated polymer solution, liquid filaments are extruded and then solidified, dried, hot-drawn, and heat-treated in a gaseous environment.

A nonwoven superabsorbent fibrous web can be produced by first forming an aqueous fiber-forming polymer solution into filaments which are contacted with a primary air stream having a velocity sufficient to attenuate the filaments. The attenuated filaments are contacted in a fiber-forming zone with a secondary air stream having a velocity effective to attenuate the filaments further, to "fragment" the filaments into fibers, and to transport the fibers to a web-forming zone. The "fragmented" fibers are collected in a reticulated web formed in the web-forming zone, and the web is cured.

A nonwoven fabric of water-soluble resin fibers can consist of water-soluble resin fine fibers having a mean fiber diameter of 30 $\mu$m or less and a basis weight of 5 to 500 g/m$^2$. The fabric can be produced by extruding an aqueous solution of water-soluble resin or a water-soluble resin melt plasticized with water through nozzles, stretching the extruded material to form fibers by a high speed gas flow, heating the fibers to evaporate the water in the fibers, and then collecting the fibers. The water-soluble resins can include poly(vinyl alcohol) when the application is directed primarily to the use of pullulan, a natural glucan. The high speed gas flow can consist of air at a temperature of from 20° C. to 60° C. at a linear velocity of 10 to 1,000 m/sec. The fibers can be dried by banks of infrared heaters located on both sides of and parallel to the fiber stream.

Some methods of forming fibrous webs or products from a solution of a polymer or molten polymer produce very short fibers and, consequently, differ significantly from meltblowing or spunbonding processes which can be used to prepare nonwoven webs from molten thermoplastic polymers.

Steam can be used in the fiber-forming process. A water-containing polymeric composition can be extruded under conditions using a supercritical fluid solution, preventing flashing, and spraying water-imbibed gelled fibers to form webs.

Meltblowing can be used in the fiber-forming process.

Coforming can be used in the fiber-forming process. Fibers or particles are commingled with meltblown fibers as they are formed.

Spunbonding can be used in the fiber-forming process.

INTRODUCTION TO THE INVENTION

Superabsorbent precursor polymers having high molecular weights, e.g., by way of example, molecular weights higher than 500,000, and minimum cross linkage can provide high fluid absorbency under load.

By superabsorbent polymer is meant a polymer which can provide high fluid absorbency under load at a level of 10 grams of 0.9% by wt. aqueous sodium chloride per gram of dry absorbent fiber or nonwoven web.

Spinning fiber from high molecular weight polymers is very challenging, even in the case where the polymer is a linear chain polymer, particularly when the molecular chain is flexible.

Ultra high modulus and high strength fibers from extremely high molecular weight polyethylene are prepared only by a slow gel spinning.

Fiber spinning from a solution of a linear chain, flexible polymer involves un-entangling and stretching of coiled and entangled polymer molecules in the solution. When these molecules are large, the process of un-entangling and stretching becomes very difficult and slow, if successful at all. The relaxation time is long.

U.S. Pat. No. 5,280,079 discloses a method of making a substantially linear acrylic polymer having a hydroxy alkyl ester comonomer. The linear polymer can be shaped into fiber, film, or coating before crosslinking occurs. However, because of the nature of esterification reaction, crosslinking initiation requires extremely high temperature (i.e., 200° C.) and takes a long period of time. In commercial practice, the method is impossible for a continuous process, especially when a continuous roll-form non-woven material is preferred.

Preparing substantially continuous fiber from a solution of high molecular weight polymer has been thought to be impossible particularly with high speed nonwoven spinning processes. The high speed nonwoven spinning process is operated at spinning speeds 10 times to 100 times higher than in the conventional textile fiber spinning. At the higher spinning speeds, micro-fiber web from high molecular weight (124,000–180,000) poly-(vinyl alcohol) was observed to become shoty, indicating fiber breakage.

It is an object of the present invention to provide a novel nonwoven web and method of preparing a preferred nonwoven web including substantially continuous superabsorbent microfiber having mechanical strength, high fluid absorbency, and preferred handling properties.

It is an object of the present invention to provide a novel nonwoven web and method of preparing a novel and preferred non-woven web including continuous superabsorbent fine fiber having mechanical strength, high fluid absorbency, and preferred handling properties.

Another object of the present invention is to provide novel and preferred substantially continuous superabsorbent microfiber and a nonwoven web including microfibers having mechanical strength, high fluid absorbency, and preferred handling properties.

A further object of the present invention is to provide preferred continuous superabsorbent fine fiber and nonwoven webs including fine fibers having mechanical strength, high fluid absorbency, and preferred handling properties.

Still another object of the present invention is to provide a disposable absorbent product which includes a preferred non-woven web including substantially continuous superabsorbent microfiber.

Yet another object of the present invention is to provide a disposable absorbent product which includes a preferred nonwoven web including continuous superabsorbent fine fiber.

These and other objects will become apparent further from a consideration of the detailed description of the specification and the figures of the drawings which follow.

SUMMARY OF THE INVENTION

The present invention provides a synthetic fibrous nonwoven web and method of preparing a novel nonwoven web of synthetic fiber. An aqueous solution of synthetic precursor polymer containing an amino functional group is extruded under defined conditions through a plurality of die orifices to form a plurality of threadlines. The threadlines are attenuated with a defined primary gaseous source to form fiber under conditions of controlled macro scale turbulence and under conditions sufficient to permit the viscosity of each threadline, as it leaves a die orifice and for a distance of no more than about 8 cm, to increase incrementally with increasing distance from the die, while substantially maintaining uniformity of viscosity in the radial direction, at a rate sufficient to provide fiber having the desired attenuation and mean fiber diameter without significant fiber breakage. The attenuated threadlines are dried with a defined secondary gaseous source. The resulting fibers are deposited randomly on a moving foraminous surface to form a substantially uniform web. The moving foraminous surface is positioned about 10 to about 100 cm from the last gaseous source to contact the threadlines. The fibers have a mean fiber diameter in the range of about 0.1 to 30 $\mu$m and are substantially free of shot. The attenuating and drying steps are carried out under conditions of controlled macro scale turbulence.

The superabsorbent fiber nonwoven webs of the present invention are useful in the production of disposable absorbent products. The superabsorbent fiber nonwoven webs of the present invention are useful particularly in the production of diapers, training pants, catamenial devices, sanitary napkins, tampons, incontinent products, and tissue wipes.

DETAILED DESCRIPTION

Figure 1:
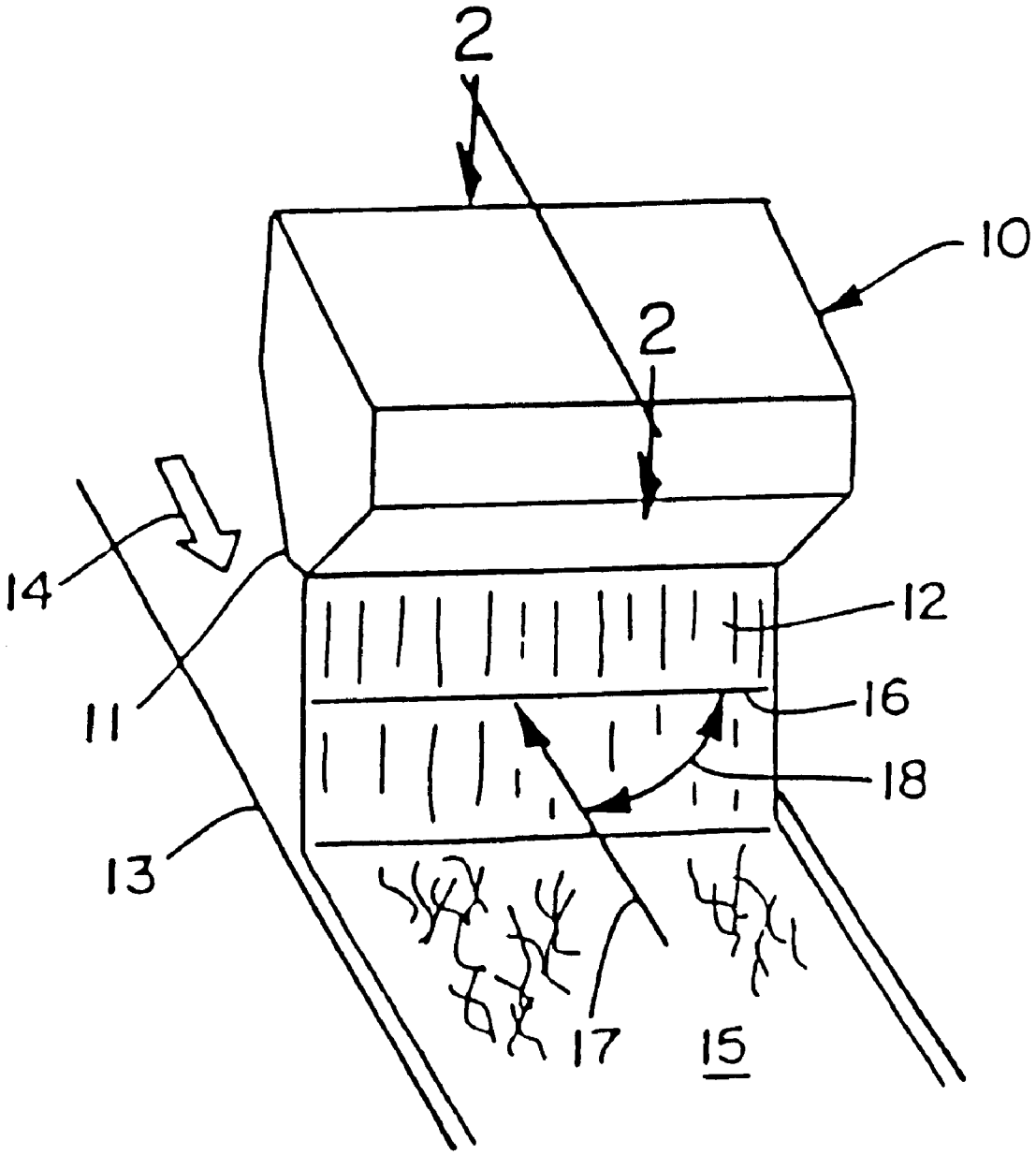
FIG. 1 is a perspective schematic view partially illustrating the preparation of a nonwoven web in accordance with one embodiment of the present invention and illustrating the horizontal angle of incidence.

The present invention provides a novel nonwoven web and method of preparing a nonwoven web of substantially continuous superabsorbent fine fiber. An aqueous polymer solution is prepared composed of about 10 to about 75 percent by weight of a linear superabsorbent precursor polymer having a molecular weight of from about 300,000 to about 10,000,000.

A water absorbent, water insoluble polymeric non-woven web in accordance with the present invention formed from a fiber, film, foam, non-woven, coating, or coform, has a gel capacity of at least about 20 grams 0.9% NaCl saline per gram dry polymer and is made by forming a substantially linear polymer by polymerization of water soluble ethylenically unsaturated monomer blends including a monomer providing carboxylic acid groups and a monomer of an amino alkyl vinyl ether or ester, or an alkylallylamine, in which the crosslinks are amide linkages formed between the carboxylic acid groups and the amino groups.

The polymer solution is extruded at a temperature in the range of about 20° C. to about 180° C., at a viscosity in the range about 3 to about 1000 Pa sec, through a die having a plurality of orifices to form a plurality of threadlines. The die orifices have diameters in the range of about 0.20 to about 1.2 mm. The resulting threadlines are attenuated with a primary gaseous source under conditions sufficient to permit the viscosity of each threadline, as it leaves a die orifice and for a distance of no more than about 8 cm, to increase incrementally with increasing distance from the die, while substantially maintaining uniformity of viscosity in the radial direction, at a rate sufficient to provide fiber having the desired attenuation and mean fiber diameter without significant fiber breakage. The primary gaseous source has a relative humidity of from about 30 to 100 percent, a temperature of from about 20° C. to about 100° C., a velocity of from about 150 to about 400 m/s, a horizontal angle of incidence of from about 70° to about 110°, and a vertical angle of incidence of no more than about 90°. The threadlines are dried to form fibers with a secondary gaseous source at a temperature of from about 140° C. to about 320° C. and a velocity of from about 60 to about 125 m/s. The secondary gaseous source has a horizontal angle of incidence of from about 70° to about 110° and a vertical angle of incidence of no more than about 90°. The fibers are deposited randomly on a moving foraminous surface to form a substantially uniform web on a scale of from about 0.4 to about 1.9 $cm^2$. The moving foraminous surface is positioned about to about 60 cm from the opening from which the last gaseous source to contact the threadlines emerges. The fibers have a mean fiber diameter in the range of from about 0.1 to about 10 $\mu$m and are substantially free of shot. The attenuating and drying steps are carried out under conditions of controlled macro scale turbulence, and the fibers are of a length such that they can be regarded as continuous in comparison with their diameters. The uniform web is exposed to a high energy source selected from the group consisting of heat, electron beam, microwave, and radio frequency irradiation to insolubilize the polymer and render crosslinks stable in the superabsorbent precursor polymer. The stabilized web is post treated for certain web structure and attributes, such as humidifying, compacting, embossing, bonding, and laminating.

The following detailed description provides specific embodiments, applicable alternatives, ranges, product, process, and apparatus variations. The present invention is further illustrated by the actual examples which follow. Such examples, however, are not to be construed as in any way limiting either the spirit or scope of the present invention.

Currently available suberabsorbents provide a water absorbent, water insoluble, polymeric material in the form of particles made by polymerizing water soluble monomer or monomer blend, e.g., acrylic acid, in the presence of a polyethylenically unsaturated monomer (e.g., N,N'methylenebisacrylamide), co-polymerized onto the polymeric backbone to cause crosslinking and to render the polymer insoluble in water. Crosslinking occurs substantially simultaneously with the polymerization. Normal methods do not permit the polymer to be shaped by extrusion or coating techniques after polymerization. Instead, the polymer is made in its desired final shape, e.g., as beads by reverse phase polymerization, or in bulk form and then is comminuted to particles. It is preferred to provide the polymer in the form of a film, fiber, foam, non-woven, coform, coating, or a shaped element.

In one aspect, a water absorbent, water insoluble polymeric element according to the present invention includes a composition formed of a substantially linear polymer by polymerization of a water soluble ethylenically unsaturated monomer blend including a monomer providing, in one aspect, a carboxylic acid group, or, in another aspect, a monomer providing amino groups that can react with the carboxylic acid groups to form amide linkages to form intermacromolecular crosslinkages.

The present invention eliminates the need to incorporate an external crosslinking agent into a solution of pre-formed linear polymer. Instead crosslinking is obtained by reaction between pendant groups on the preformed polymer.

An acrylic acid and hydroxy alkyl ester copolymers composition allows the making of a substantially linear polymer which is shaped into a desired final shape, and provides the crosslinking to insolubilize the polymer. The crosslinking is ester linkage between carboxylic acid groups and hydroxylic groups. Esterification requires a high temperature and a long period of time to produce the crosslinking reaction which needs a very long equipment to handle the crosslinking reaction if a continuous process in manufacturing is used and also prohibits coforming or coating the polymer onto the materials which are not able to undergo high temperature, such as polyethylene, polypropylene, or cellulose pulp.

An advantage is provided by the present invention conveniently to make a substantially linear polymer and shape the polymer into a desired final shape, and then to provide the crosslinking on-line in a short period of time and at a mild temperature which does not cause negative damage on any other materials used.

The substantially linear polymer in accordance with the nonwoven web and method of the present invention is made in solution, preferably an aqueous solution, and the solution is shaped before the formation of the crosslinkages. The monomers used for providing the crosslinks form the polymer and shape the polymer without crosslinking occurring, and cause substantially complete crosslinking by appropriate treatment of the shaped polymer.

Preferred carboxylic monomers in accordance with the non-woven web and method of the present invention are acrylic acid or an ethylenically unsaturated carboxylic acids. Examples of the suitable carboxylic monomers include, but are not limited to, acrylic acid, maleic anhydride, or methyl acrylic acid. Carboxylic monomers may be present in the final polymer in free acid or water soluble salt form, suitable salts being formed with ammonia, amine, or alkali metal. The proportion of salt and free acid groups can be adjusted before or after polymerization or after formation of the crosslinked polymer. A preferred ratio is provided in the range of from about 1:0.2 to 1:10 of free carboxylic acid/alkali metal or other salt carboxylic acid groups in the final polymer (and often also in the monomers used to form the linear polymer).

Preferably, the ratio is at least 1:2 and more preferably 1:3 free carboxylic acid/alkali metal. Preferably, the ratio is below 1:6 carboxylic acid/alkali metal, and, the ratio is below 1:5 carboxylic acid/alkali metal. Above a ratio of 1:6 carboxylic acid/alkali metal, a problem develops in the form of a lack of available crosslinking sites because of a high degree of neutralization. The absorbent polymer exhibits a low absorbency Just under load, soft gel, wicking, or intaking functionalities. Below a ratio of 1:2 carboxylic acid/alkali metal, a problem develops in the form of a lack of charge density of the polymer because of a low degree of neutralization. The absorbent polymer exhibits a low overall absorbency.

Promoting internal crosslinking reaction is preferred. At least portions of the carboxylic acid groups preferably are present as free acid groups before the crosslinking occurs. For example, for this purpose, 10% to 80%, preferably 25% to 60%, and more preferably 30% to 40% of the acid groups are in the free acid form before crosslinking occurs.

The monomer providing amino groups for internal amidation with the carboxylic acid groups in accordance with the nonwoven web and method of the present invention is selected from ethylenically unsaturated monomers that can react with carboxylic acid groups to form the desired amide linkages. The monomer must be one that does not form the amide crosslinks during the initial polymerization to make the linear polymer, and which does not form any substantial number of crosslinks during the shaping of the linear polymer.

Preferred monomers in accordance with the nonwoven web and method of the present invention containing free amino groups are selected from the group including amino vinyl ethers, amino vinyl esters, or allylamines. A preferred vinyl ether in accordance with the nonwoven web and method of the present invention is an amino alkyl vinyl ether. A preferred vinyl ester is an amino alkyl ester of carboxylic vinyl monomer. Allylamine includes both allylamine and alkylallylamines. The monomer may be monofunctional, containing a single amino group, or may be poly-functional, containing two, three, or more amino groups per vinyl group. The amino alkyl group contains from 1 to 10, preferably 1 to 8 carbon atoms. Suitable monomers include, but are not limited to, 3-amino-1-propanol vinyl ether, 4-amino-1-butanol vinyl ether, 2-diethylamino ethyl methacrylate, allylamine, 2-methylallylamine, and 2-ethylallylamine.

The amount of amino monomer is 0.1 to 10%, preferably 1 to 5%, and the amount of carboxylic acid (or salt) is above 50%, and preferably above 70%. Amounts are by weight based on total monomers. The blend is formed of 90–99% acrylic acid, a portion being in salt form, and 1 to 10% amino alkyl vinyl ether or amino alkyl vinyl ester or allylamine.

Polyacrylic acid as free acid and/or salt is a glassy and brittle polymer. It is preferred to include polyacrylic acid in the polymer plasticizing monomers. The use of amino alkyl ethers or esters containing 6 to 10 carbon atoms promotes plasticization. Additional plasticization monomer promotes softness and provides a preferred flexibility of the resultant polymer. Suitable plasticization monomers are vinyl alkyl esters, such as ethyl methacrylate, vinyl acetate butyl methacrylate, di or triethylene glycol vinyl ether, and 2-ethyl hexyl methacrylate. The alkyl group of the ester preferably contains 2 or more carbon atoms and less than 24 carbon atoms.

The amount of the plasticization monomer is below 30%, preferably below 20%, by weight based on the monomers used for forming the substantially linear polymer.

The substantially linear water soluble polymer is formed from the monomer blend. In one aspect, it is pre-formed and then dissolved to form a polymer solution. In one aspect, it is made by reverse phase polymerization for a monomer blend soluble in water or by water-in-oil emulsion polymerization for a monomer blend insoluble in the water. A risk of polymer contamination by surfactant is not preferred. Preferably, the polymer is made by aqueous solution or solution polymerization methods. In one aspect, the polymer is dried, but preferably, the polymer is not dried because there always exists some water-insoluble swollen gel particles in the polymer solution prepared by the drying, then redissolving process. The drying process can introduce unwanted chemical reactions to the polymer. Preferably, the polymer is formed by solution polymerization in the solvent in which it is to be shaped, e.g., water.

In one aspect, the polymerization is conducted in the presence of conventional initiators or chain transfer agents or a combination of conventional initiators and chain transfer agents to provide a preferred molecular weight. If the molecular weight of the linear polymer is too low, the physical properties of the article can be inadequate, e.g., providing only a low absorbency under load value. Preferably, the polymer molecular weight is at least 100,000 and, more preferably, at least 500,000. For a molecular weight higher than about 20,000,000, it is difficult to shape an adequately concentrated solution of the polymer. The molecular weight is below 20 million, preferably below 10 million, and more preferably below 5 million.

The polymer concentration is at least 5% and below 70%. Preferably, the polymer concentration is 10% to 50% and, more preferably, 15% or 20% to about 35%. The concentration is dependent on the shaping processes. The concentration of the polymer for fiber/non-woven spinning process is between 20% to up to 40%.

The polymer solution to be extruded has a viscosity at 20° C. of at least 100,000, and preferably at least 120,000 cps. In one aspect, the polymer solution to be extruded has a viscosity in the range of 120,000 to 400,000 cps. Higher values are unnecessary because a high viscosity produces a high extrusion pressure. Die pressures which are too high reduce throughput. The viscosities are measured at 20° C. using a Brookfield RVT spindle 7 at 20 rpm. The viscosity preferably is also relatively high at the spinning temperature, which is elevated, e.g., at a temperature of about 80° C. to 90° C. Preferably, the solution of 90° C. has a viscosity of at least 5,000 or 10,000 cps and more preferably at least 20,000 cps. In one aspect, the solution viscosity is in the range from 50,000 to 100,000 cps.

The present invention provides particular value when the shaping is by extrusion of the solution of the substantially linear polymer to include a shaped element having one dimension at least five times a second dimension. In this manner, fibers and films are made. The shaping involves coating the solution on a surface but preferably includes extruding it as a fiber or film. Substantially immediately after extruding or otherwise shaping the solution, the linear polymer reagent forms a uniform solid mixture in the form of an article of the desired shape. The article is initially very soft because of the presence of residual solvent, e.g., water. By soft is meant that the article can be elongated or its shape can be changed relatively easily when external forces are applied. The conversion of the liquid solution to the soft solid articles is by precipitation and involves solvent evaporation, solvent extraction, solvent sublimation, or insolubilizing the polymer.

The shaping is formed by wet spinning into an organic solvent that removes water, for example, acetone, methyl ethyl ketone, or other lower ketone, or into an inorganic aqueous salt solution of lithium chloride or aluminum sulphate. Alternatively, shaping is by dry spinning. Preferably, the polymer remains slightly damp until the final crosslinking to maintain softness. In a preferred method, an aqueous solution of the linear polymer is spun at a temperature between 20° C. to 90° C., preferably between 50° C. to 90° C., more preferably between 70° C. to 390° C., to form a product which is substantially dry on the surface but contains at least 10% residual moisture. The dry spun product is cured by heating.

In the case of fiber spinning process, the fiber made is collected as either individual fiber, such as staple fiber or filament, or non-woven material. Preferably, the superabsorbent fiber is converted further into a continuous structure in application. The further conversion uses about 5% to 20% binder fiber, e.g., in the form of a polyethylene fiber, or another adhesive material. An advantage of directly making the non-woven structure is provided when the process itself creates inter-fiber bonding points, when the non-woven is processed continuously in a roll form, thereby simplifying the product manufacturing process, such as a diaper manufacturing process.

Crosslinking is promoted by incorporating a catalyst in a solution of the polymer or by exposing the shaped polymer to a catalyst, e.g., by passing the polymer through an atmosphere or solution of a catalyst for the amidation reaction. Preferably, however, the amidation is conducted in the absence of added catalyst to provide absorbency.

The monomers preferably are selected for amidation by irradiation. In one asspect, amidation is by heating the shaped substantially linear polymer to a temperature above room temperature for a sufficient time period for the crosslinking reaction to occur, e.g., 100° C. to 150° C. for 5 to 40 minutes. At a higher temperature, a shorter reaction time is appropriate, e.g., 0.1 to 10 minutes at 200° C. to 250° C.

Another three factors are related to heat curing. One factor is the degree of neutralization of polycarboxylic acid. A lower degree of neutralization needs a lower temperature, e.g., the linear polymer can be totally crosslinked even at 60° C. when the degree of neutralization is below 20%. A second factor is the physical dimension of the shaped articles. The third factor is the chemical structure of amino comonomer.

We have found that the larger dimension requires a lower temperature or shorter time. A 300 to 600 micron particulate polyacrylate polymer containing 1% amino propanol vinyl ether requires about 5 minutes at 140° C. to be insolubilized. The same composition polymer when spun into fiber/non-woven with a fiber diameter of less than 10 microns takes more than 40 hours at 140° C.

In respect to the third factor of the chemical structure of the amino comonomer, in the case of amino alkyl vinyl ether, the number of amino groups on each monomer or the chain length of alkyl group is related to curing condition. A longer alkyl chain allows amino group easily to reach available carboxylic acid group for amidation, thereby to reduce either curing temperature or curing time.

Additional components are included in the solution to be shaped to modify the properties of the final product. In one aspect, external plasticizer is incorporated. The amount of material other than the crosslinked polymer is held below 20%, preferably below 10%, by weight of the final article.

The shaped element has a gel capacity of at least 20 g 0.9% NaCl saline under no external pressure, and at least 10 g 0.9% NaCl saline under an external pressure of 0.3 pound per square inch, per gram dry polymer.

The present invention provides a disposable absorbent product having a preferred nonwoven web including substantially continuous or continuous superabsorbent fiber.

The superabsorbent fiber nonwoven webs of the present invention are useful in the production of disposable absorbent products. The superabsorbent fiber nonwoven webs of the present invention are useful particularly in the production of diapers, training pants, catamenial devices, sanitary napkins, tampons, incontinent products, and tissue wipes.

It has been found through empirical development that high absorbency nonwoven webs including substantially continuous fiber, i.e., having very little "shots," were obtained through a high speed nonwoven spinning process, with novel process modification, from extremely high molecular weight superabsorbent precursor polymers as high as 8,000,000.

The mechanism of the novel fiber forming is believed to involve a strong affinity of water molecules toward the carboxyl group of sodium polyacrylic acid copolymer which, for example, may render the long polymer chain stiffer, thereby facilitating un-entangling and stretching. The mechanism may involve ionic repairing of the carboxyl group of the sodium polyacrylic acid copolymer.

A substantially preferred nonwoven web has been prepared from sodium polyacrylic acid copolymer under a novel process including a meticulous control of the gaseous environment, into which solution threadlines are extruded, in humidity and temperature, preventing premature excessive evaporation of solvent water before wet threadlines are attenuated into a desirable fine size without breakage or "fragmentation." The substantially continuous fiber contained very little "shot," and the webs were very soft and uniform particularly when turbulence of the primary steam and the secondary hot drying airs were controlled.

"Web uniformity" is a term which is used herein to refer to the extent to which any portion of a nonwoven web produced in accordance with the present invention having a given area is like any other portion having the same area. Web uniformity is a function of fiber diameter and the manner in which fibers are deposited on the moving foraminous surface. Ideally, any given area of the web will be indistinguishable from any other area with respect to such parameters as porosity, void volume, pore size, web thickness, and the like. However, uniformity variations are manifest in webs as portions which are thinner than other portions. Such variations can be estimated visually to give a subjective determination of uniformity. Alternatively, web uniformity can be qualitatively estimated by measuring web thickness or light transmission through the web.

The term "relatively small scale" is used throughout this specification in reference to web uniformity and defines the approximate area of each of several portions of the web which are to be compared. In general, the scale typically will be in the range of from about 0.4 to about 6.5 $cm^2$, depending upon the mean fiber diameter. When the mean fiber diameter is 10 $\mu$m or less, the appropriate area in $cm^2$ for evaluating web uniformity, i.e., the scale, is 0.19 times the mean fiber diameter in $\mu$m or 0.4 cm, whichever is greater. The scale is determined by multiplying the mean fiber diameter by 0.19 when the mean fiber diameter is in the range of about 2.1 to about 10 $\mu$m. For mean fiber diameters of about 2.1 $\mu$m or less, however, the scale is 0.4 $cm^2$. When the mean fiber diameter is greater than 10 $\mu$m, the appropriate multiplier is 0.215. The phrase "on a scale of from about 0.4 to about 6.5 $cm^2$" means that the area of one portion of a nonwoven web which is to be compared with other portions of the same web, each of which portions has essentially the same area, will be in the range given. The area selected, in $cm^2$ will be (1) approximately 0.19 times the mean fiber diameter in um when the mean fiber diameter is 10 $\mu$m or less or 0.4 $cm^2$, whichever is greater, or (2) approximately 0.215 times the mean fiber diameter when the mean fiber diameter is greater than 10 $\mu$m.

As used herein, the term "shot" refers to particles of polymer which generally have diameters greater than the average diameter of the fibers produced by the extrusion process. The production of shot typically is associated with filament breakage and the accompanying accumulation of polymer solution on the die tip.

The term "molecular weight" refers to weight average molecular weight, unless stated otherwise.

The term "turbulence" is used herein to refer to the departure in a fluid, typically a gas, from a smooth or streamlined flow. The term is meant to apply to the extent or degree to which the fluid flow varies erratically in magnitude and direction with time and is essentially variable in pattern. The term "macro scale turbulence" means only that the turbulence is on a scale such that it affects the orientation and spacing of the fibers or fiber segments relative to each other as they approach the web-forming surface, in which the length of such fiber segments is equal to or less than the scale. Turbulence is "controlled" when its magnitude is maintained below an empirically determined level. The minimal turbulence can be achieved by the proper selection of process variables and is permitted to increase only to an extent necessary to achieve a given objective.

Because of the difficulty of measuring turbulence, an indirect means for determining when turbulence is being controlled to a sufficient degree must be used. Such indirect means is web uniformity. Web uniformity is defined as a function of both the area of the web to be evaluated and the mean diameter of the fibers of which the web is composed. For example, producing nonwoven webs will give a very uniform product if the scale, i.e., the area of the web used for comparison purposes, is large, for example, on the order of several square meters. At the other extreme, uniformity of the same web is very poor if the scale is so small that it is on the order of the mean diameter of the fibers. The scale selected for the evaluation of webs prepared in accordance with the present invention, therefore, is based on producing nonwoven webs by several processes for a variety of applications.

The term "threadline" is used throughout the specification and claims to refer to the shaped article formed as the polymer solution is forced through a die orifice but before such shaped article has solidified or dried. A threadline is essentially liquid or semisolid. The term "fiber" is used to designate the solidified or dried threadline. The transition from a threadline to a fiber is gradual.

In respect to the "back side" and "front side" of the threadline curtain, the back side of the curtain is the side toward which the moving foraminous surface approaches. The foraminous surface then passes under the threadline curtain and moves away from it with a nonwoven web having been formed there-on. The side where the web has been formed is the front side of the threadline curtain.

Whenever possible, all units are SI units (International System of Units), whether Basic or Derived. Thus, the unit for viscosity is the pascal-second, abbreviated herein as Pa s. The pascal-second is equal to 10 poise, the more common unit of viscosity.

Turning first to the method of the present invention for preparing a substantially preferred nonwoven web including superabsorbent fibers, such method generally includes the following steps:

A. preparing an aqueous polymer solution of a linear superabsorbent precursor polymer;

B. extruding the resulting polymer solution through a die having a plurality of orifices to form a plurality of threadlines;

C. attenuating the resulting threadlines with a primary gaseous source;

D. drying the attenuated threadlines with a secondary gaseous source to form fibers;

E. depositing the resulting fibers randomly on a moving foraminous surface to form a substantially uniform web; and F. insolubilizing the fiber into a water swellable but water insoluble web.

The first two steps are independent of the apparatus or details of the process employed. As will become evident hereinafter, however, this is not the case for the remaining steps. That is, some of the limitations of the attenuating, drying, and depositing steps depend on whether the superabsorbent precursor fibers produced are substantially continuous or continuous.

The first step (step A) of the method involves preparing an aqueous superabsorbent precursor polymer solution which includes from about 10 to about 75 percent by weight of the polymer. Because the solubility of the polymer in water is inversely proportional to the polymer molecular weight, higher concentrations, i.e., concentrations above about 40 percent by weight, are practical only when polymer molecular weights are below about 100,000. The preferred concentration range is from about 20 to about 60 percent by weight. Most preferably, the concentration of superabsorbent precursor polymer in the solution is in the range of from about 25 to about 40 percent by weight.

The superabsorbent precursor polymer of the present invention has a molecular weight of from about 300,000 to about 10,000,000. The preferred ranges are from about 3,000,000 to about 8,000,000, more preferably from about 500,000 to about 4,000,000.

The superabsorbent precursor polymer solution also contains, besides a cross linkable moiety in the polymer backbone and/or cross linking agents, minor amounts of other materials, i.e., amounts of other materials that together constitute less than 50 percent by weight of the total solids content of the solution. Such other materials include, by way of illustration only, plasticizers, such as polyethylene glycols, glycerin, and the like; colorants or dyes; extenders, such as clay, starch, and the like; other functional substances; and the like.

In the second step (step B), the polymer solution is extruded at a temperature of from about 20° C. to about 180° C. and a viscosity at the extrusion temperature of from about 3 to about 1000 Pa s through a die having a plurality of orifices to form a plurality of threadlines, which orifices have diameters in the range of from about 0.20 to about 1.2 mm. The extrusion temperature preferably will be in the range of from about 70° C. to about 95° C. The preferred polymer solution viscosity is from about 5 to about 30 Pa s. The orifices in the die preferably will have diameters of from about 0.3 to about 0.6 mm. The orifices are arranged in as many as about 7 multiple rows. Such rows are perpendicular to the direction of travel of the moving foraminous surface upon which the nonwoven web is formed. The length of such rows defines the width of the web which is formed. Such arrangement of orifices results in a "sheet" or "curtain" of threadlines. The thickness of such curtain is determined by the number of rows of orifices, but it is very small in comparison with the width of the curtain. For convenience, such curtain of threadlines occasionally will be referred to herein as the "threadline plane." Such plane is perpendicular to the moving foraminous surface upon which the web is formed, although such an orientation is neither essential nor required.

While solution viscosity is a function of temperature, it also is a function of polymer molecular weight and the concentration of the polymer in the solution. Consequently, all of these variables need to be taken into consideration to maintain the solution viscosity at the extrusion temperature in the proper range.

The resulting threadlines then are attenuated in step C with a primary gaseous source to form fibers under conditions sufficient to permit the viscosity of each threadline, as it leaves a talkie orifice and for a distance of no more than about 8 cm, to increase incrementally with increasing distance from the die, while maintaining uniformity of viscosity in the radial direction. The rate of threadline attenuation must be sufficient to provide fibers having the desired strength and mean fiber diameter without significant fiber breakage. The primary gaseous source has a relative humidity of from about 40 to 100 percent and a temperature of from about 20° C. to about 100° C., a horizontal angle of incidence of from about 70° to about 110°, and a vertical angle of incidence of no more than about 90°.

When substantially continuous fibers are being formed, the velocity of the primary gaseous source is in the range of from about 150 to about 400 m/s. The more preferred primary gaseous source velocity is from about 60 to about 300 m/s. The primary gaseous source velocity most preferably is in the range of from about 70 to about 200 m/s. For the production of continuous fibers, however, the velocity of the primary gaseous source is in the range of from about 30 to about 150 m/s.

The attenuation step involves a balance between attenuating aspects and drying aspects since some loss of water from the threadlines usually is inevitable. However, optimum attenuating conditions may not always coincide with optimum drying conditions. Consequently, a conflict between the two parameters may arise which requires finding a compromise set of conditions.

It is important that the threadlines be attenuated to the desired level without breakage. An excessive attenuation rate creates excessive stress on the threadlines which leads to frequent threadline or fiber breaks and increased shot formation, particularly with microfibers having diameters in the range of from about 0.1 to about 10 $\mu$m. Too slow an attenuation rate, though, fails to give sufficiently strong fibers. On the other hand, too rapid threadline drying, especially during the attenuation step, results in increased breaks and increased shot production. If threadline drying is too slow during the drying step, excessive interfiber bonding or fusing occurs as a result of the fibers being too wet as they are laid down on the moving foraminous surface. Consequently, ideal drying conditions typically are not optimum for the production of highly attenuated, strong fibers. Thus, the somewhat opposing requirements for attenuating and drying the threadlines are accomplished by controlling the relative humidity and temperature of the primary gaseous source, as well as its velocity. The attenuating step results in no more than partial drying of the threadlines to provide the required incremental increase in threadline viscosity.

Drying of the attenuated and partially dried threadlines is accomplished in step D by means of a secondary gaseous source. The secondary gaseous source has a temperature of from about 140° C. to about 320° C. The vertical and horizontal angle of incidence requirements are the same as those for the primary gaseous source. For substantially continuous fiber production, the secondary gaseous source has a velocity of from about 60 to about 125 m/s. The production of continuous fibers requires a secondary gaseous source having a velocity of from about 30 to about 150 m/s.

As used herein, the term "primary gaseous source" means a gaseous source which is the first to contact the threadlines upon emergence from the die. The term "secondary gaseous source" refers to a gaseous source which contacts the threadlines or fibers after the threadlines have been contacted by the primary gaseous source. Thus, "primary" and "secondary" refer to the order in which two gaseous sources contact the threadlines after they have emerged from the die. Subsequent gaseous sources, if used, would be referred to as "tertiary," "quaternary," and so forth. Although coming within the spirit and scope of the present invention, the use of such subsequent gaseous sources usually is neither practical nor necessary and, consequently, is not preferred, with two exceptions which will be described later.

Each of the gaseous sources required by steps C and D, and each additional gaseous source, if used, preferably will comprise at least two gaseous streams, with two streams being more preferred. When two streams are employed, they are located on opposite sides of the threadline curtain or plane. The stream impinging the filaments from the front side of the threadline curtain has a positive vertical angle of incidence, whereas the stream impinging the filaments from the back side of the threadline curtain has a negative vertical angle of incidence. However, the absolute value of the vertical angle of incidence for each stream must be within the limitations described herein, although both streams need not have the same absolute value for their vertical angles of incidence. Consequently, it should be understood that the requirement with respect to the vertical angle of incidence refers to an absolute value when a gaseous source involves more than one gaseous stream.

In the last step of the method of the present invention, step E, the fibers resulting from the previous step are deposited randomly on a moving foraminous surface. In the case of substantially continuous fiber production, the moving foraminous surface is from about 10 to about 60 cm from the opening from which the last gaseous source to contact the threadlines emerges. The distance between the moving foraminous surface and such opening on occasion is referred to herein as the forming distance. The mean fiber diameter is in the range of from about 0.1 to about 10 $\mu$m. The fibers are substantially uniform in diameter and are substantially free of shot.

When continuous fibers are produced, the forming distance preferably is from about 10 to about 100 cm, and the mean fiber diameter is in the range of from about 10 to about 100 $\mu$m. The continuous fibers produce a substantially uniform web.

The area or scale used for comparison purposes in evaluating web uniformity is a function of fiber diameter. The scale for a web including substantially continuous fibers is in the range of from about 0.4 to about 1.9 $cm^2$, while the scale for a web including continuous fibers is in the range of from about 1.9 to about 6.5 $cm^2$.

Step C requires controlled macro scale turbulence and conditions sufficient to permit the viscosity of each threadline, as it leaves a die orifice, to increase incrementally with increasing distance from the die, while maintaining uniformity of viscosity in the radial direction, at a rate sufficient to provide fibers having the desired attenuation and mean fiber diameter without significant fiber breakage. The means for meeting both requirements involves controlling four parameters or variables associated with the gaseous source, including relative humidity, temperature, velocity, and orientation relative to the threadline curtain. Macro scale turbulence primarily is a function of gaseous stream velocity and the orientation of the gaseous source as it impinges the threadline curtain. The viscosity of the threadline, although affected by gaseous source velocity, is a function of the relative humidity and temperature of the primary gaseous source. Such parameters or variables are discussed below in respect to "Macro Scale Turbulence" and "Threadline Viscosity."

Referring now to Macro Scale Turbulence, attenuating and Nondrying are carried out under conditions of controlled macro scale turbulence. In a preferred embodiment, attenuating and drying are carried out under conditions of minimal macro scale turbulence, thereby assisting the formation of a web which is substantially uniform. As used herein, the term "minimal macro scale turbulence" means only that degree of turbulence which will permit the desired uniform web formation to occur which is in part dependent on uniform fiber spacing and orientation.

Some turbulence is unavoidable, indeed necessary, given the fact that attenuation results from the entrainment of threadlines in a moving gaseous stream. A minimum gaseous stream velocity is determined empirically. The minimum gaseous source velocity is much higher than the extrusion velocity.

In certain instances, macro scale turbulence is greater than minimal, although still controlled. For example, when fibers or particles are to be commingled with the threadlines as they are formed, a greater degree of turbulence is required to achieve a degree of commingling which is sufficient to provide a coherent uniform web.

Macro scale turbulence also is a function of the nature of the gaseous source and its orientation as it impinges the threadline curtain. In addition, the efficiency of threadline attenuation is, at least in part, dependent upon gaseous source orientation. Gaseous source orientation is defined by the horizontal angle of incidence and the vertical angle of incidence.

The horizontal angle of incidence is best defined with reference to FIG. 1. FIG. 1 is a perspective schematic view partially illustrating the preparation of a nonwoven in accordance with one embodiment of the present invention.

Referring now to FIG. 1, polymer solution is extruded through a plurality of orifices in face 11 of die 10 to form threadline curtain 12. As threadline curtain 12 meets foraminous belt 13 moving in the direction of arrow 14, nonwoven web 15 is formed. Line 16 lies in the plane of threadline curtain 12 and is parallel with face 11 of die 10. Arrow 17 represents the orientation of a gaseous stream relative to line 16, with the direction of flow being in the same direction as arrow 17. Angle 18 formed by line 16 and arrow 17 is the horizontal angle of incidence. Angle 18 is determined relative to the right-hand portion of line 16 with respect to an observer facing die 10, toward whom foraminous belt 13 is moving. The horizontal angle of incidence of each gaseous source is in the range of from about 70° to about 110°, with an angle of about 90° being preferred.

Figure 2:
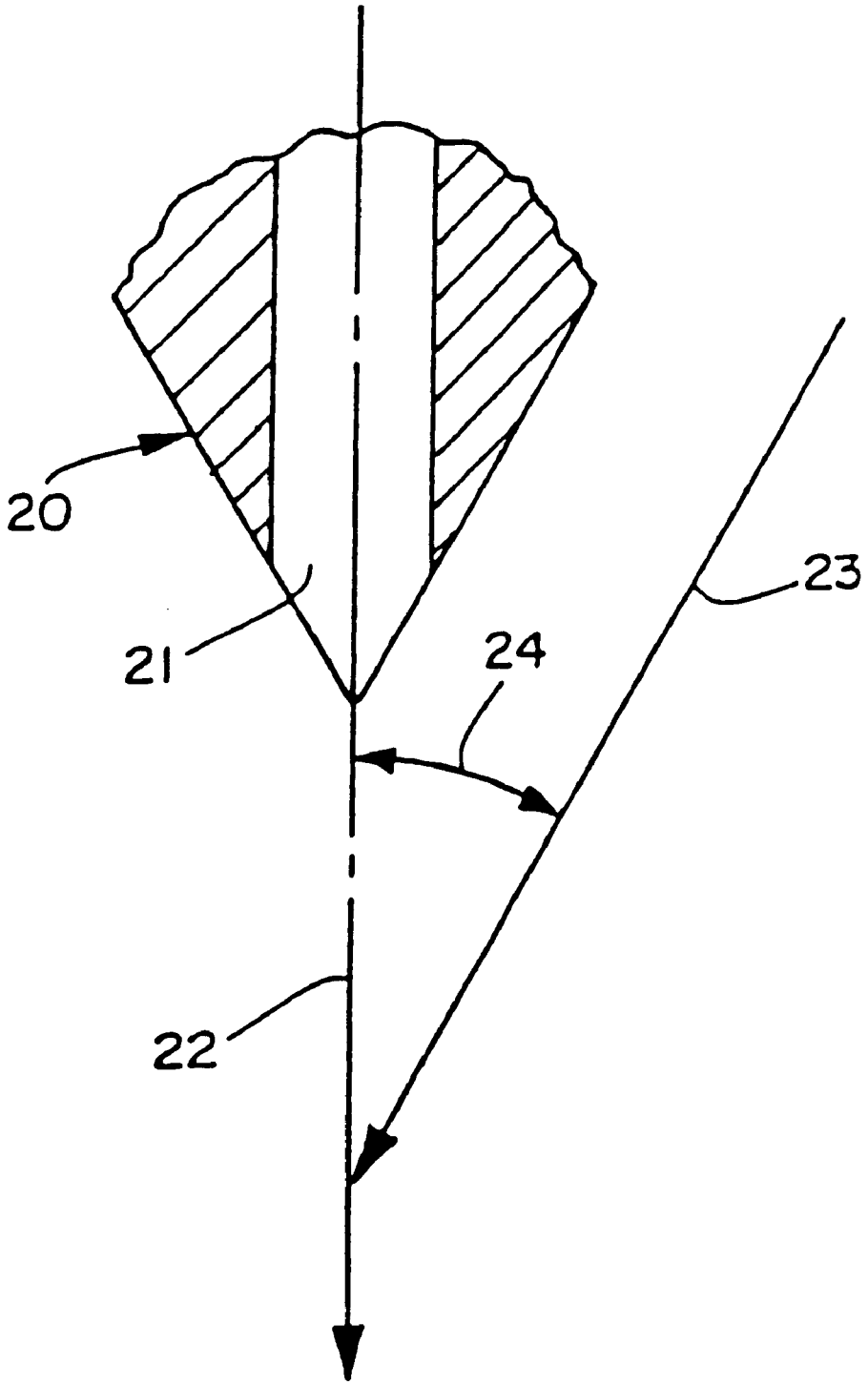
FIG. 2 shows a cross-section view of the lower part of the die tip portion of the die of FIG. 1, taken along line 2—2. The figure illustrates the vertical angle of incidence.

The vertical angle of incidence is best defined with reference to FIG. 2. FIG. 2 shows a cross-section view of a small portion of die 20 having orifice 21, taken along line 2—2 of FIG. 1.

Referring now to FIG. 2, arrow 22 represents the centerline of the threadline (not shown) emerging from orifice 21, with the direction of flow being the same as the direction of arrow 22. Arrow 23 represents the orientation of a gaseous stream relative to arrow 22, with the direction of flow being in the same direction as arrow 23. Angle 24 formed by arrows 21 and 22 is the vertical angle of incidence. The vertical angle of incidence of any gaseous source will be no more than about 90°. Preferably, the vertical angle of incidence will be no more than about 60°, and most preferably no more than about 45°. The preferred values for the vertical angle of incidence refer to absolute values when any given gaseous source involves more than one gaseous stream.

Macro scale turbulence is in part a function of the orientation of the gaseous source. From a consideration of FIGS. 1 and 2, the horizontal angle of incidence has the least effect on macro scale turbulence (i.e., web uniformity) when such angle is about 90°. Similarly, the vertical angle of incidence has the least effect on macro scale turbulence when it is about 0°. As the horizontal angle of incidence deviates from 90° and/or the vertical angle of incidence increases above 0°, macro scale turbulence is reduced by decreasing the gaseous source velocity.

The macro scale turbulence of any gaseous source needs to be decontrolled carefully along the entire width of the threadline curtain. Such control is accomplished through the use of manifold designs. For example, a manifold is used having a gradually reduced cross-section. In addition, a combination of honeycomb sections with screens or sintered, porous metal baffles effectively destroys the undesired large scale turbulent eddy currents which may otherwise be formed.

As the controlled high velocity gaseous source exits the opening of a duct or manifold, it entrains the surrounding ambient air, and its velocity is decreased as the distance from such opening increases. During the momentum transfer between the high velocity gaseous source and the ambient air, the size of turbulent eddies increases. Small scale turbulent eddies help entangle the fibers at an early stage near the opening from which the gaseous source emerges, but eddies which grow at distances of around 50 cm or more from such opening adversely affect web uniformity by the formation of heavy and light basis weight areas in the web. It is important that formation distances be kept within the limits specified herein. Moreover, some ambient air entrainment is essential for keeping large scale eddy currents at a minimum.

In respect to Threadline Viscosity, the primary gaseous source has a relative humidity of from about 30 to 100 percent. More preferably, such gaseous source will have a relative humidity of from about 60 to about 95 percent. Most preferably, the relative humidity of the primary gaseous source will be in the range of from about 60 to about 90 percent.

It has been found that the presence of water droplets in the humidified gaseous source has adverse effects on threadline and fiber formation, particular with respect to the formation of shot. Consequently, it is preferred that any water droplets which may be present in the humidified gaseous source have diameters less than the diameters of the threadlines. Most preferably, the humidified gaseous stream is essentially free of water droplets.

In practice, water droplets are removed successfully from the humidified gaseous source through the use of an impingement separator. Additionally, it is helpful to heat all passageways through which the humidified gaseous source passes prior to impinging the threadlines. However, passageway temperatures should be such that the temperature of the humidified gaseous source remains within acceptable limits as already described.

The temperature of the primary gaseous source is in the range of from about 20° C. to about 100° C. Such temperature more preferably is in the range of from about 40° C. to about 100° C., and most preferably from about 60° C. to about 90° C.

Figure 3:
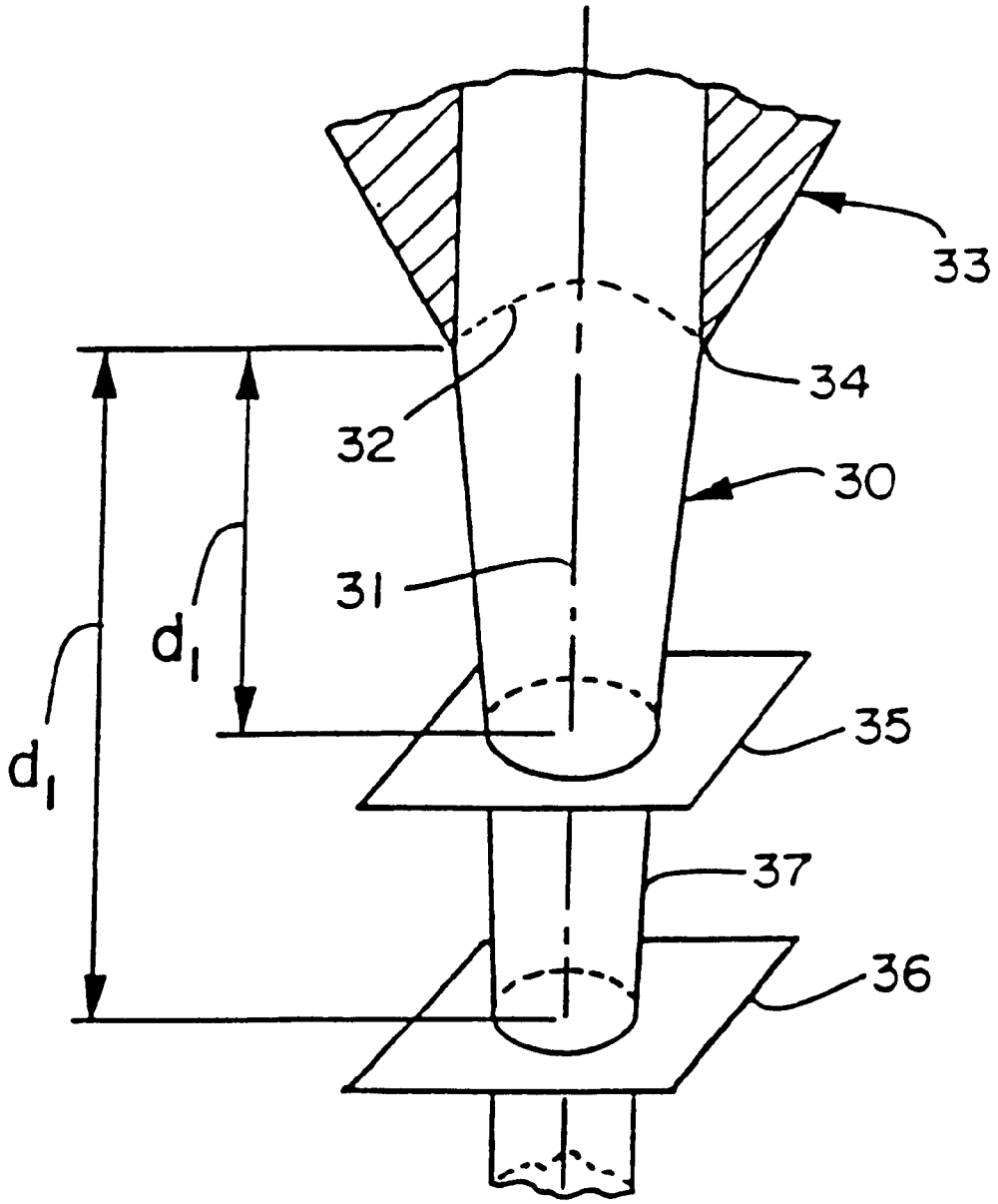
FIG. 3 is a perspective view of a portion of a superabsorbent threadline produced in accordance with the present invention.
Figure 4:
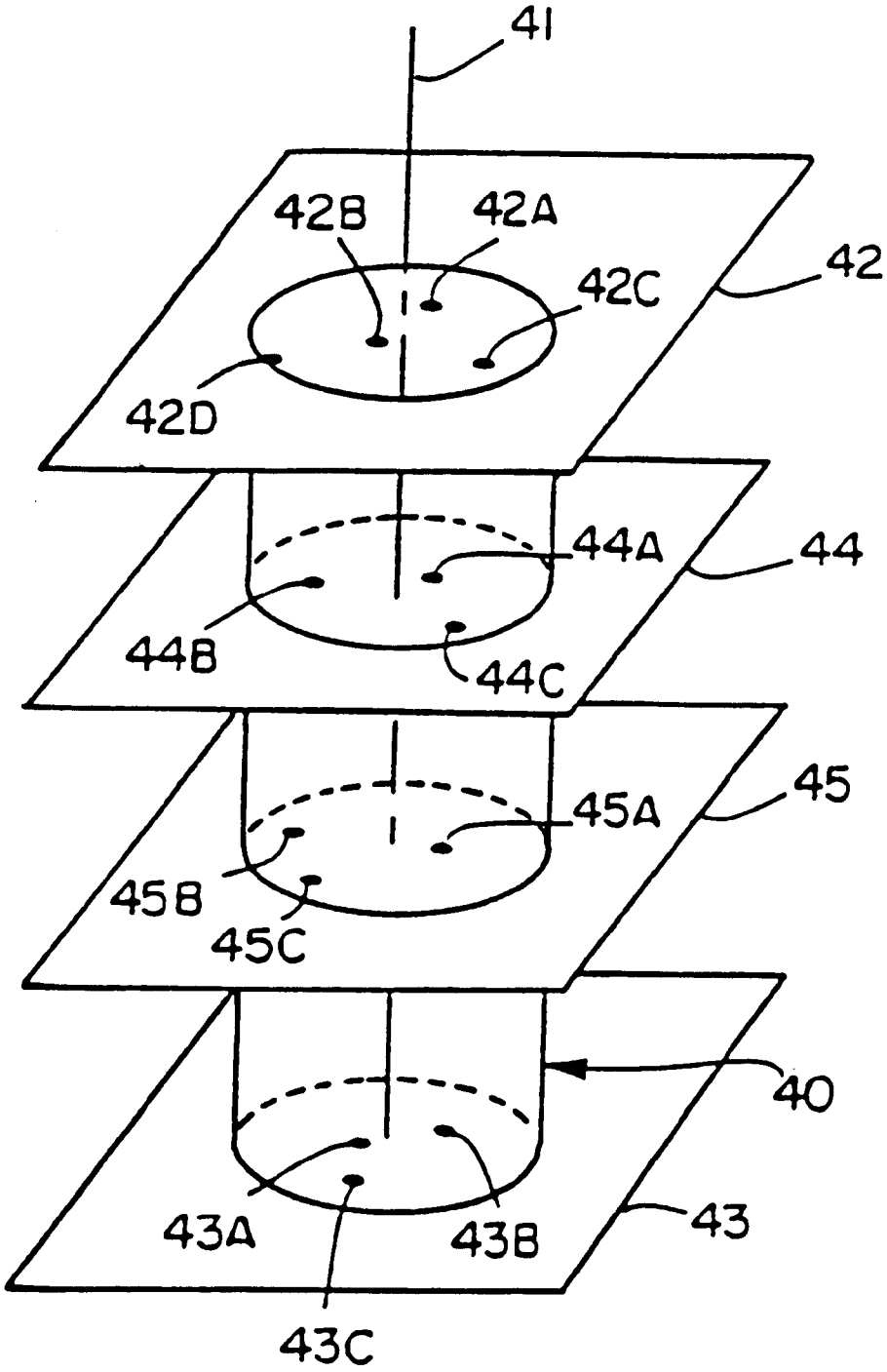
FIG. 4 is a perspective view of a portion of the threadline shown in FIG. 3.
Figure 5:
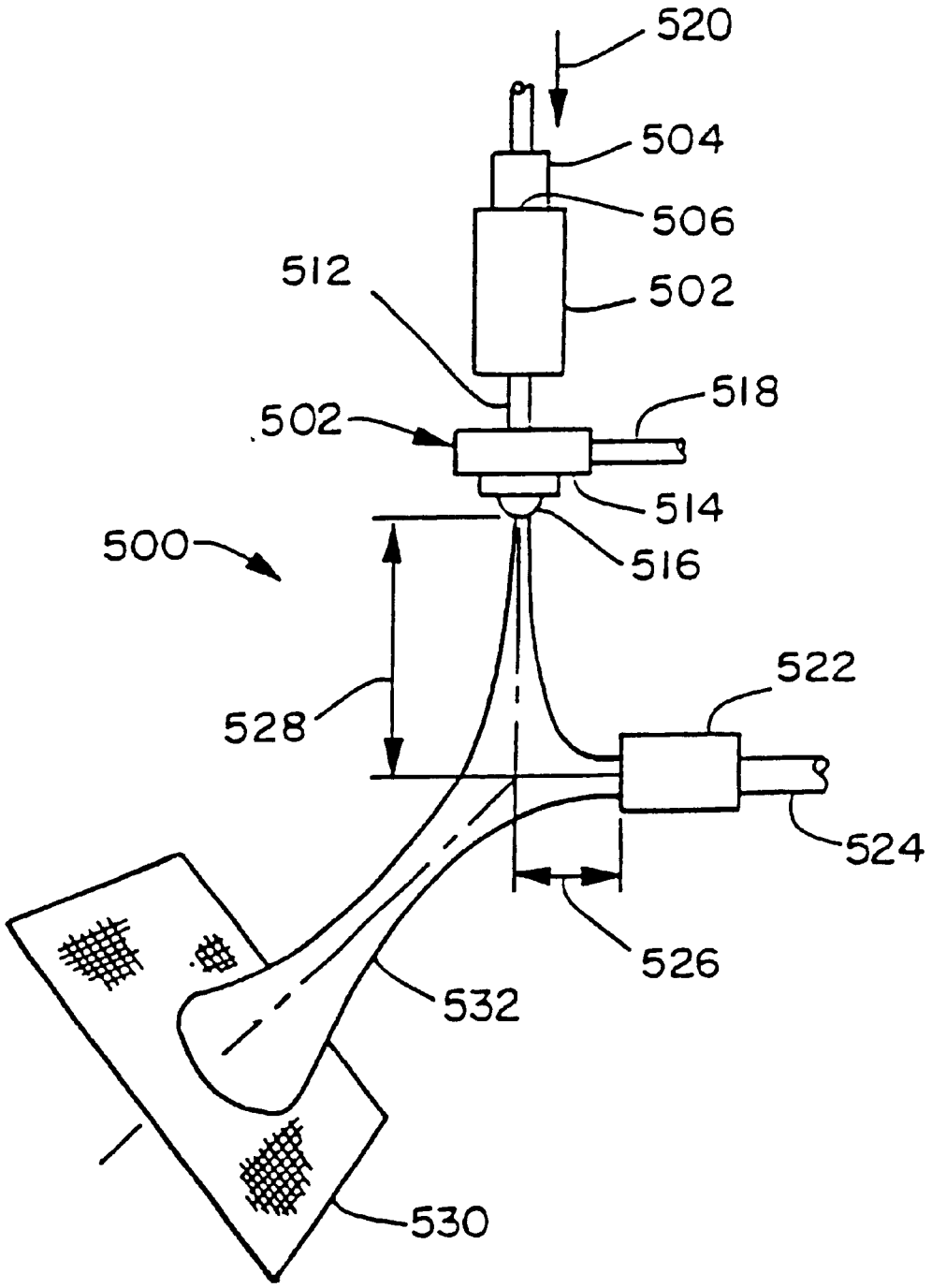
FIG. 5 is a schematic representation of one embodiment of the present invention.

The viscosity requirements are understood with reference to FIGS. 3 and 4. FIG. 3 is a perspective view of a portion of threadline 30 having longitudinal axis 31 as it emerges from orifice 32 in die 33 (shown in partial cross-section) having face 34. Plane 35 is perpendicular to axis 31 and is at a distance d, from die face 34. Plane 36 also is perpendicular to axis 31 and is at a distance $d_2$ from die face 34, with $d_2$ being greater than $d_1$ (i.e., $d_2>d_1$). Section 37 of threadline 30 lies between planes 35 and 36. Because threadline 30 is being attenuated, the diameter of the threadline decreases with increasing distance from the die. Consequently, section 37 of threadline 30 approximates an inverted truncated cone or, more properly, an inverted frustrum of a cone.

Portion 37 of threadline 30 of FIG. 3 which is located between planes 35 and 36 of FIG. 3 is shown in perspective view in FIG. 4. In FIG. 4, threadline portion 40 has axis 41 and is defined by upper plane 42 (i.e., plane 35 in FIG. 3), and lower plane 43 (i.e., plane 36 in FIG. 3). Both planes are perpendicular to axis 41 and are parallel with each other. Additional planes 44 and 45 are shown, which planes also are perpendicular to axis 41 (or parallel with planes 42 and 43) and are at distances $d_3$ and $d_4$, respectively, from the face of the die which is not shown (i.e., face 34 of die 33 in FIG. 3). Upper plane 42 and lower plane 43 are at distances $d_1$ and $d_2$, respectively, from the face of the die. Thus, $d_1<d_3<d_4<d_2$. Points 42A, 42B, 42C, and 42D lie in upper plane 42. Similarly, points 43A, 43B, and 43C lie in lower plane 43; points 44A, 44B, and 44C lie in plane 44; and points 45A, 45B, and 45C lie in plane 45.

With reference to FIG. 4, uniformity of viscosity in the radial direction provides that the viscosity of the threadline at any point lying in a plane perpendicular to axis 41 is approximately the same. That is, the viscosity of the threadline at points 42A, 42B, 42C, and 42D is essentially the same. Moreover, the viscosity at points 43A, 43B, and 43C is essentially the same; the viscosity at points 44A, 44B, and 44C is essentially the same; and the viscosity at points 45A, 45B, and 45C is essentially the same.

However, the viscosity of the threadline increases incrementally with increasing distance from the die. That is, the viscosity of the threadline at any of points 44A, 44B, and 44C, again with reference to FIG. 4, is greater than the viscosity at any of points 42A, 42B, 42C, and 42D. The viscosity at any of points 45A, 45B, and 45C in turn is greater than the viscosity at any of points 44A, 44B, and 44C. Finally, the Viscosity at any of points 43A, 43B, and 43C is greater than the viscosity at any of points 45A, 45B, and 45C.

All of the foregoing viscosity relationships can be expressed mathematically as follows, in which hpn is the viscosity at point n:

$$h_{P43A} \gg h_{P43B} \gg h_{P43C} > h_{P45A} \gg h_{P45B} \gg h_{P45C} > h_{P44A} \gg h_{P44B} \gg h_{P44C} > h_{P42A} \gg h_{P42B} \gg h_{P42C} \gg h_{P42D}$$

The extent of the increase of viscosity with increasing distance from the die is critical over the distance from the die specified herein. However, the increase should not be so large as to contribute to fiber breakage or so small that the threadline does not solidify sufficiently before reaching the moving foraminous surface on which the nonwoven web is formed. The term "incrementally" is associated with the increase in viscosity to convey the concept that such increase is a slight or imperceptible increase from a given plane having a very small thickness to the next or adjacent plane downstream from the die. Thus, such change in viscosity can be considered to be the derivative dy/dx, where dy is the increase in viscosity resulting from an increase dx in distance from the die when such increase in distance approaches zero.

It is problematic to measure the viscosity of the threadline at any given point, or to measure or estimate the concentration and temperature from which a viscosity could be calculated or estimated. Nevertheless, it has been determined empirically that the foregoing conditions for viscosity must exist when fibers having the required characteristics, including the absence of shot, desired fiber diameters, and desired molecular orientation attenuation are obtained. Significant deviations from such viscosity requirements produce shot, broken fibers, irregular web formation, and/or fibers having highly variable and irregular diameters.

It has been found that fibers or particles can be commingled with the threadlines. Primary and secondary gaseous sources are employed with the fibers or particles being introduced into the secondary gaseous source. When two secondary gaseous streams are employed, which is preferred, the fibers or particles can be included in either or both of the secondary gaseous streams.

Alternatively, three gaseous sources can be employed in the preparation of a coformed web, including a primary gaseous source, a secondary gaseous source, and a tertiary gaseous source. In a first exception to the general avoidance of the use of a subsequent gaseous source, i.e., a gaseous source in addition to primary and secondary gaseous sources, the fibers or particles are included in the tertiary gaseous source, in which case a single tertiary gaseous stream usually is sufficient. When a fiber-carrying or particle-carrying tertiary gaseous source is employed, the tertiary gaseous source will be at ambient temperature and have a velocity of from about 5 to about 15 m/s. While a heated gaseous source can be used, care must be taken to avoid softening the fibers to an extent which causes excessive bonding of the superabsorbent precursor fibers to each other and/or to the fibers or particles with which they are intermingled.

A second exception relates to the formation of a non-woven web from continuous fibers. In this case, three gaseous sources contribute to the control of turbulence and, consequently, to preferred web uniformity. The characteristics of the three gaseous sources are described briefly below.

The primary gaseous source has a relative humidity of from about 40 to 100 percent, a temperature of from about 20° C. to about 100° C., a horizontal angle of incidence of from about 70° to about 1100, and a vertical angle of incidence of no more than about 90°. The velocity of the primary gaseous source is no more than about 45 m/s. Such velocity preferably will be in the range of from about 5 to about 15 m/s. The function of the primary gaseous source is to provide the conditions necessary to permit the required threadline viscosity increases as described hereinbefore. The primary gaseous source in this case functions as a conditioning source.

The secondary gaseous source has a temperature of from about 20° C. to about 100° C., a horizontal angle of incidence of from about 70° to about 110°, and a vertical angle of incidence of no more than about 90°. The velocity of the secondary gaseous source typically is no more than about 45 m/s. The velocity of the secondary gaseous source is in the range of from about 5 to about 15 m/s. The secondary gaseous source serves to partially dry the threadlines partially, although a small degree of attenuation also may take place.

Finally, the tertiary gaseous source has a lower temperature and a higher velocity than either the primary gaseous source or the secondary gaseous source. The tertiary gaseous source functions to attenuate and more fully dry the fibers. The tertiary gaseous source has a temperature in the range of from about 10° C. to about 50° C. The velocity of the tertiary gaseous source ranges from about 30 to about 245 m/s. In addition, such gaseous source has a horizontal angle of incidence of from about 70° to about 110° and a vertical angle of incidence of no more 7, than about 90°.

EXAMPLE I

A copolymer of 74.5% by weight sodium acrylate, 24.4% by weight of acrylic acid, and 1.1% by weight of 3-amino-1-propanol vinyl ether (APVE) was prepared as a 25% by weight solution in water. Potassium persulfate $K_2S_2O_8$ in an amount of 0.15% by weight based on the total weight of monomers was used as initiator. Polymerization was carried out in a 2 liter reactor at 70° C. for at least 3 hours. The viscosity of this solution was cps (Brookfield RVT at 20 rpm spindle 7 at 20° C.).

The polymer was dried and particulate powder having a particle size ranging from 300 to 600 microns was prepared of this polymer and heated at 60° C. for four days after which time the polymer was crosslinked and was observed to absorb 35 times its own weight of 0.9% NaCl saline and 20 times its own weight of 0.9% NaCl saline under a 0.3 psi pressure.

A comparative sample was made using the same recipe as described above but ethylene glycol vinyl ether (EGVE) was used as the crosslinking monomer to replace the APVE. The polymer required a curing temperature at least 150° C. for more than one day in order to insolubilize the polymer. Absorbency properties of this polymer were similar to the polymer having APVE as crosslinking monomer.

The results show that the amino functionality cures at a lower temperature than ethylene glycol vinyl ether, i.e., at a reduced crosslink temperature below that required for the hydroxyl functionality used to form the esterification.

EXAMPLE II

The two polymer solutions prepared in Example I, of either APVE or EGVE crosslinking monomer, were separately spun into a continuous non-woven material having a fiber diameter about 5 to microns and a web basis weight of about 50 gram per square meter. The non-woven containing APVE was heated at 140° C. for 16 hours and had a free swell capacity of 25 g/g and an absorbency under load (AUL) of 17 g/g in 0.9% NaCl saline. The non-woven containing EGVE had to be cured at 200° C. for 16 hours resulting in similar free swell capacity and AUL capacity.

The results show that the amino functionality cures at a temperature about 60° C. lower than ethylene glycol vinyl ether in the fiber form, i.e., at a reduced crosslink temperature below that required for the hydroxyl functionality used to form the esterification in the fiber form.

EXAMPLE III

The two polymer solutions prepared in Example I, of either APVE or EGVE crosslinking monomer, were separately spun into continuous non-woven material while coforming with cellulose wood pulp fiber (Coosa CR54) in a ratio of 33% by weight of polyacrylate copolymer fiber and 67% by weight of wood pulp fiber.

The coform had a basis weight of 150 gram per square meter and a density of 0.02 g/cc. The polyacrylate fiber diameter was 5 to 8 microns, and the pulp fiber diameter was 20 to 30 microns.

The coform including APVE polyacrylate was heated at 150° C. for 16 hours and demonstrated a free swell capacity of 15 g/g and an AUL capacity of 11 g/g in 0.9% NaCl saline. However, the coform including EGVE polyacrylate had to be heated at 150° C. for days before it became a water swellable, water insoluble material.

The absorbent properties of the coform including EGVE polyacrylate were similar to the coform including APVE polyacrylate. The coform made from the polymer containing EGVE underwent significant discoloration and had a charred odor compared to the coform from the APVE copolymer which was not significantly discolored and had no odor.

The results show that a shorter curing time provided when the amino functionality reduces the curing time below that required for the hydroxyl functionality used to form the esterification is important when coform is used, e.g., fluff which can only withstand a temperature of about 140° C. At temperatures above about 140° C., the fluff will oxidize, discolor, and release a burning odor. Ethylene glycol vinyl ether (EGVE) was used as the crosslinking monomer and requires about 150° C. for 10 days, which is long for the use of coform. Amino functionality required only 16 hours at the same temperature.

In one aspect, the present invention provides a copolymer of ethylenically unsaturated monomer blends comprising carboxylic and amino functional groups. The ethylenically unsaturated monomers containing carboxylic groups include acrylic acid, maleic acid, methyl acrylic acid, maleic anhydride, crotonic acid, fumaric acid, itaconic acid, mesaconic acid, maleamic acid, citraconic anhydride, methyl itaconic anhydride, ethyl maleic anhydride, and their mixtures, or partially neutralized salts.

The ethylenically unsaturated monomers containing free amino groups are selected from, but are not limited to, amino vinyl ethers, amino vinyl esters or allylamines. The preferred vinyl ethers are amino alkyl vinyl ethers. The preferred vinyl esters are amino alkyl esters of carboxylic vinyl monomers. Allylamine includes both allylamine and alkylallylamines. In one aspect, the monomer is monofunctional, containing a single amino group. In another aspect, the monomer is polyfunctional, containing two, three, or more amino groups per vinyl group. The amino alkyl group contains from 1 to 10 carbon atoms, preferably 1 to 6 M carbon atoms. The monomers include 3-amino-1-propanol vinyl ether, 4-amino-1-butanol vinyl ether, 2-diethylamino ethyl methacrylate, allylamine, 2-methylallylamine, and 2-ethyl-allylamine.

EXAMPLE IV 2.29 kg of sodium hydroxide (NaOH) was dissolved in 21.8 kg of distilled water at room temperature in a 10 gallon reactor obtained from Pfaudler U.S., Inc. in Rochester, N.Y., Model DWV 50210-AKC. To this solution were added 5.9 kg of acrylic acid, 87.5 g of 3-amino-1-propanol vinyl ether, and 11.97 g of potassium persulfate ($K_2S_2O_4$) and dissolved while the solution was agitated at room temperature. Polymerization was initiated and continued for 5 hours at 60° C. The molecular weight of the polymer solution was 1,550,500. The solution was transferred into an autoclave and pressurized by compressed air at a pressure of 80 to 100 psi. The solution then was extruded by a metering pump at 70° C. through a spinning plate having 20 orifices per inch with a diameter of orifice 0.35 mm. The primary gaseous source was heated compressed air humidified by the steam. The relative humidity of the primary gaseous source was greater than 90 percent. The secondary gaseous source was compressed air heated to a temperature of 260° C. to 370° C. The exit velocities of the primary and secondary gaseous sources were 800 feet per second 244 meters per second) and 500 feet per second (152 meters per second), respectively.

The non-woven material collected had a fiber diameter of 5 to 8 microns and a web basis weight of 50 gram per square meter. The non-woven then was heated at 170° C. for different amounts of time after which the cured non-woven was subjected to absorbency tests in a 0.9% NaCl saline with or without a 0.3 psi pressure. Table 1 lists the absorbency data.

The results show the effect of cure times on absorbency using the amino functional group in a larger scale (10 gallon) reactor.

TABLE 1

| | Curing Time (hrs) | | | | |
|---|---|---|---|---|---|
| | 1 | 2 | 3 | 4 | 5 |
| AUL (g/g @ 0.3 psi) | 7.6 | 9.2 | 10.3 | 15.7 | 17.4 |
| AUZL (g/g) | 34.6 | 31.2 | 28.4 | 25.1 | 24.3 |

The Absorbency Test Procedures were provided. Superabsorbent fibers/composites were cut into 1-inch diameter discs and stacked to about 0.16 g±0.01 g. The sample was placed into a plastic AUL test cylinder with a 100 mesh screen on its bottom. A plastic piston was placed on the top of the discs that generated a pressure of about 0.01 psi. The cylinder was then placed into a dish that contained about 50 ml of 0.9% NaCl saline. After 1 hour, the cylinder was taken out and placed on paper towel to blot interstitial fluid. The blotting was continued by moving the cylinder to dry paper towel until there was no fluid mark visible on the paper towel. The weight difference of the cylinder between wet and dry represented total amount of fluid absorbed by the sample and was reported as the Absorbency Under Zero Load (AUZL). Absorbency Under Load (AUL) was done using the same apparatus and procedure used for AUZL measurements, except a 100 gram weight was placed on the plastic piston which generated a pressure of about 0.3 psi. Absorbency Tests are described in more detail in WO 99/17695 in the section titled "Flooded Absorbency Under Zero Load."

EXAMPLE V

The same recipe as described in Example IV was used to prepare the polymer solution except that 175 g of 3-amino-1-propanol vinyl ether was added. The molecular weight of the polymer solution was 865,150. The solution was spun into continuous non-woven material having a fiber diameter of 5 to 8 microns and a web basis weight of 50 gram per square meter. The non-woven then was heated at 140° C. for different amounts of time after which time the cured non-woven was subjected to absorbency tests in a 0.9% NaCl saline with a 0.3 psi pressure. Table 2 lists the absorbency data.

The results show polymerization at different amounts of APVE and different molecular weight at moderate temperatures and cure times using the amino functional group in a larger scale (10 gallon) reactor.

TABLE 2

| | Curing Time (hrs) | | | | |
|---|---|---|---|---|---|
| | 1 | 2 | 3 | 4 | 5 |
| AUL (g/g @ 0.3 psi) | 9.1 | 11.5 | 16.3 | 18.9 | 18.1 |

In one aspect, the present invention provides a copolymer of ethylenically unsaturated monomer blends comprising carboxylic and hydroxylic functional groups. The ethylenically unsaturated monomers having carboxylic functional groups include acrylic acid, maleic acid, methyl acrylic acid, maleic anhydride, crotonic acid, fumaric acid, itaconic acid, mesaconic acid, maleamic acid citraconic anhydride, methyl itaconic anhydride, ethyl maleic anhydride, and their mixtures, or partially neutralized salts.

The ethylenically unsaturated monomers containing free "hydroxylic groups are selected from, but are not limited to, alkylene glycol vinyl ethers, alkylene glycol vinyl esters or " hydroxy alkyl esters. Examples of alkylene glycol vinyl ethers include ethylene glycol vinyl ether, propylene glycol vinyl ether, diethylene glycol vinyl ether, triethylene glycol vinyl ether, 1,4-cyclohexanedimethanol vinyl ether, 1,6-hexanediol vinyl ether, 1,4-butanediol vinyl ether. Examples of alkylene glycol vinyl esters include ethylene glycol acrylate, ethylene glycol methacrylate, propylene glycol methacrylate, hexapropylene glycol mono-methacrylate, and tripropylene glycol acrylate. Examples of hydroxy alkyl esters include hydroxy propyl methacrylate, glyceryl mono acrylate.

Figure 6:
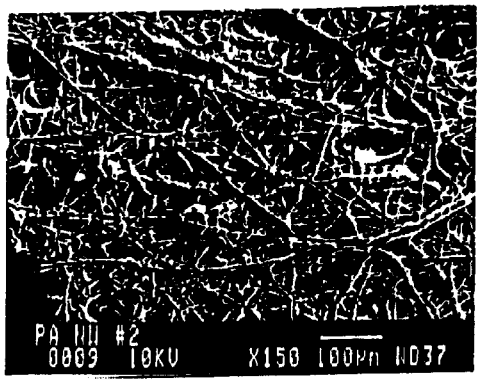
FIG. 6 shows scanning electron micrographs SEM for non-wovens in accordance with one embodiment of the present invention.
Figure 6:
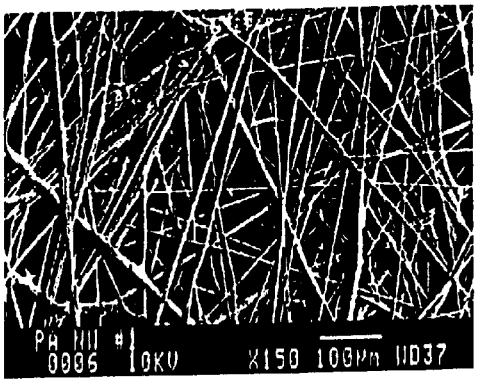
Figure 6:
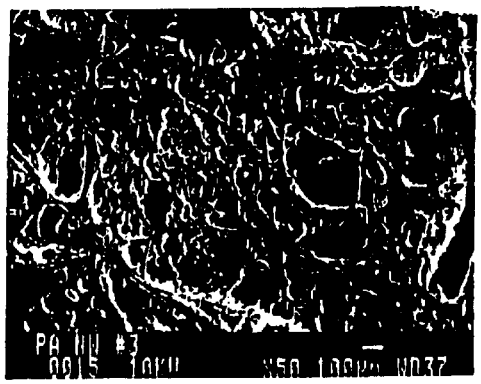

EXAMPLE VI 2.49 kg of sodium hydroxide (NaOH) was dissolved in 23.8 kg of distilled water at room temperature in a 10 gallon reactor. To this solution 6.44 kg of acrylic acid, 137.7 g of ethylene glycol vinyl ether, and 9.5 g of potassium persulfate ($K_2S_2O_4$) were added and dissolved while the solution was agitated at room temperature. The solution was purged with nitrogen and heated to 60° C. Polymerization was initiated and continued for 5 hours at 60° C. The molecular weight of the polymer was 1,800,000. The solution was transferred into an autoclave and pressurized by compressed air at a pressure of 80 to 100 psi. The solution then was extruded by a metering pump at 70° C. through a spinning plate having 20 orifices per inch with a diameter of orifice of 0.35 mm. The primary gaseous source was heated compressed air humidified by the steam. The relative humidity of the primary gaseous source was greater than 70 percent. The secondary gaseous source was compressed air heated to a temperature of 260 to 370° C. The exit velocities of the primary and secondary gaseous sources were 800 feet per second (244 meters per second) and 500 feet per second (152 meters per second), respectively. The ratio of steam to hot compressed air was adjusted from 80/20 to 0/100 in order to evaluate the effect of steam on fiber formation in the present invention. FIG. 6 shows the scanning electron micrographs SEM photos of the web produced. FIG. 6 shows SEM pictures of polyacrylate solution blown non-wovens for (a) steam/hot air=0/100, (b) steam/hot air=50/50, and (c) steam/hot air=80/20.

The results show the effects of different relative humidities on fiber formation, including no steam, poor fiber forming; 50/50, good fiber forming; and 80/20, melted under too much moisture. Even though a preferred solution is used, preferred conditions using steam are required to form fibers having dimensional integrity.

EXAMPLE VII 1.58 kg of sodium hydroxide (NaOH) was dissolved in 17.0 kg of distilled water at room temperature in a 10 gallon reactor. To this solution 4.09 kg of acrylic acid, 87.5 g of ethylene glycol vinyl ether, and 6.035 g of potassium persulfate ($K_2S_2O_4$) were added and dissolved while the solution was agitated at room temperature. The solution was purged with nitrogen and heated to 60° C. Polymerization was initiated and continued for 5 hours at 60° C. The molecular weight of the polymer solution was 1,800,000. The solution was transferred into an autoclave and pressurized by compressed air at a pressure of 80 to 100 psi. The solution then was extruded by a metering pump at 70° C. through a spinning plate having 20 orifices per inch with a diameter of orifice of 0.35 mm. The primary gaseous source was heated compressed air humidified by the steam. The relative humidity of the primary gaseous source was greater than 90 percent. The secondary gaseous source was compressed air heated to a temperature of 260° C. to 370° C. The exit velocities of the primary and secondary gaseous sources were 800 feet per second (244 meters per second) and 500 feet per second (152 meters per second), respectively. The web made was heat cured at 200° C. for up to 20 hours. The cured material was evaluated by the Absorbency Under Load test.

Table 3 summarizes the results of this Example VII.

Using pure polymer and the same batch of solution, the results show the effects of curing time on absorbency data.

TABLE 3

| | Curing Time (hrs) | | | | |
|---|---|---|---|---|---|
| | 1 | 2 | 6 | 13 | 20 |
| AUL (g/g @ 0.3 psi) | 11.6 | 13.8 | 15.9 | 19.1 | 18.7 |

EXAMPLE VIII

In order to prepare a coformed web, the procedure of Example IV was repeated separately with the same polyacrylate solution. A largely softwood pulp sheet of Coosa CR1654, manufactured by a former Kimberly-Clark Corporation at its Coosa Pines, Ala. Mill, now Alliance Forest Products Inc., was fiberized with a hammer mill and then blown with air at a velocity of 24 m/s through a rectangular duct having a depth of 2.5 cm. The dilution rate, defined as grams of fiberized pulp per cubic meter of carrier air volume, was kept in the range of from 2.8 to 8.5 to minimize flocculation. The resulting air-borne fiber stream then was injected into the threadline-carrying first secondary gaseous stream at the region where the threadline-carrying first secondary gaseous stream and second secondary gaseous stream met. Both the vertical and horizontal angles of incidence of the airborne fiber stream were about 90°. The stream exited the rectangular duct about 10 cm from the region where the two secondary gaseous streams met. The coformed web made was heat cured at 140° C. for up to 20 days. The cured material was evaluated by both the Absorbency Under Load test and the Vertical Wicking test.

Table 4 summarizes the results of this Example VIII.

The results show the effects of making coform and the curing time effect on AUL and VWD. The results show preferred AUL value does not correspond to preferred VWD value.

TABLE 4

| Curing Time (days) | AUL (@ 0.3 psi) g/g) | Vertical Wicking Distance in saline @ 1 hr (cm) |
|---|---|---|
| 2 | 1.4 | 0 |
| 5 | 8.6 | 1.0 |
| 8 | 12.5 | 5.3 |
| 11 | 13.2 | 5.3 |
| 13 | 13.8 | 10.9 |
| 15 | 12.9 | 11.7 |
| 20 | 12.6 | 13.4 |

EXAMPLE X

Samples listed in Table 5 are absorbent structures prepared composed of superabsorbent fibers, cellulose wood pulp, sodium bicarbonate, and superabsorbent particles. The superabsorbent fibers included an aqueous polymer solution of about 25 percent by weight of a linear superabsorbent precursor prepared in the following manner. 18 kilograms of distilled water at ambient temperature was added to the 10 gallon Pfaudler reactor obtained from Pfaudler U.S., Inc. in Rochester, N.Y., Model DWV 50210-AKC. To this solution 6.0 kilograms of Acrylic acid, and 240 grams of 3-amino-1-propanol vinyl ether and 50.0 grams of potassium persulfate were added and dissolved while the solution was mixed at ambient temperature. The solution was heated to 60 degrees centigrade during which time the polymerization was initiated. The reaction was completed after 5 hours. The solution then was removed from the reactor and solution spun into fibers using the process and equipment disclosed in the preferred embodiment of this patent. In the process of forming the superabsorbent fiber and prior to collecting the fibers on a moving foraminous surface, cellulose wood fibers and superabsorbent particles were introduced into the superabsorbent fiber stream. The fluff used in these examples was CR1654. The cellulose wood fibers were supplied in roll form and were a made up of 84 percent softwood fiber and 16 percent hardwood fibers. The wood fibers were fiberized into individual fibers using a hammer mill. The pulp fibers then were air conveyed through a rectangular duct and injected into the superabsorbent fiber stream. The superabsorbent particles of Favor 880 made by Stockhausen Inc. and the sodium bicarbonate supplied by Aldrich Chemical company were dry blended in preferred weight ratios and introduced into the superabsorbent fiber stream by means of a Christy Coat-O-Matic model 10"-DE-S made by Christy Machine Company of Fremont, Ohio. The coform absorbent material then was densified by passing the material through a pair of smooth calendar rolls. The gap between the rolls was adjusted to provide a final density of 0.3 gram per cubic centimeter. The coform material then was placed ovens and heated cured for two hours at 130 degrees centigrade.

A number of coform absorbent composites formed having varying concentrations of wood pulp fluff, superabsorbent particles, sodium bicarbonate, and superabsorbent fibers were subjected to physical property testing. The components employed in forming the absorbent composites and their physical properties are set forth in Table 5.

TABLE 5

| Sample | Fluff wt. % | SAM part. wt. % | SAM fiber wt. % | NaHCO3 wt. % | SAM fiber type | Sat. Cap. (g/g) | Vert. Wick. Ht. (cm) | Tensile Dry/ Wet |
|---|---|---|---|---|---|---|---|---|
| 1 | 20 | 53.3 | 14.7 | 12 | A | 20.6 | 10.6 | 4.5/.21 |
| 2 | 20 | 43 | 20.6 | 16.4 | A | 19.7 | 11.4 | 4.1/.18 |
| 3 | 20 | 33 | 26.2 | 20.8 | A | 17.2 | 14.2 | 4.5/.48 |
| 4 | 25 | 55 | 20 | 0 | A | 21.0 | 10.5 | 4.8/.27 |
| 5 | 35 | 33 | 20 | 12 | A | 15.3 | 17.0 | 8.6/.50 |
| 6 | 47 | 33 | 20 | 0 | B | 19.9 | 11.6 | .62/.13 |

As can be seen from Table 5, the addition of about 12 to 40 flyweight percent solution spun coformed superabsorbent fibers (SAM fiber type "A") provides preferred wet/dry tensile strength over an air laid composite containing superabsorbent fiber as shown in example 6, (fiber type "B") a staple superabsorbent fiber, Oasis type 101, 6 mm×10 dtex made by Allied Colloid Corporation.

EXAMPLE XI

The Stiffness of the cured cofom nonwoven including SAF and wood pulp fluff was evaluated. Samples listed in Table 6 are absorbent structures comprising superabsorbent fibers, cellulose wood pulp, and superabsorbent particles. The superabsorbent fibers in this experiment were synthesized with 2% by weight of comonomer, 3-amino-1 propanol vinyl ether (APVE) at a degree of neutralization of 70% for the acrylic acid. The spinning polymer syrup contained 25% copolymer by weight. Absorbent Sample X was composed of 33% Superabsorbent fiber, 33% Superabsorbent powder, remainder cellulose wood pulp and weighed 425 g per $m^2$. Sample X retained 17.0 g saline per g of sample at 0.5 psi. Absorbent Sample Y was composed of 66% Superabsorbent fiber, remainder cellulose wood pulp and weighed 200 g per $m^2$. Sample Y retained 13.0 g saline per g of sample at 0.5 psi. The samples X and Y were cut into 1.5"×1" pieces by sharp edged fabric cutters and were stored in a variable humidity chamber. Experiments were performed to monitor the stiffness of these composites at different conditions when the relative humidity was first increased to 80% and then decreased to ambient conditions such as 24%. The stiffness of the composite samples were measured by a properly calibrated Gurley Digital Stiffness Tester (Model #4171-D). The results are tabulated in the following Table 6.

TABLE 6

| | | Composite X | | Composite Y | |
|---|---|---|---|---|---|
| Relative Humidity % | Time Elapsed hours | Moisture gain wt. % | Stiffness mg | Moisture gain wt. % | Stiffness mg |
| 24 | 0 | 0 | 1454 | 0 | 1969 |
| 81 | 14 | 17.7 | 483 | 44 | 79 |
| 67 | 17 | 15.6 | 655 | 23.3 | 91 |
| 60 | 20 | 10.5 | 1262 | 17.2 | 102 |
| 51 | 23 | 4.3 | 3490 | 10.4 | 946 |
| 24 | 33 | 1.4 | 4601 | 2.8 | 2586 |
| 40 | 36 | 4.0 | 4300 | 5.4 | 2508 |
| 44 | 39 | 4.1 | 4074 | 5.0 | 2154 |
| 60 | 42 | 10.75 | 1400 | 17.2 | 172 |
| 71 | 45 | 19.3 | 417 | 26.6 | 98 |

The absorbent composites, when kept in relative humidity of 80% or greater for 3 or more hours, showed enhanced flexibility. However, when the humidity was reduced back down to ambient conditions, the absorbent composites showed a high degree of stiffness. The stiffness of absorbent composites A and B increased sharply while drying between a relative humidity of 60% and 50%.

At high humidity, moist superabsorbent fibers and particles become quite flexible due to swelling, and the hydrogen bonding is increased among the entities of fibers, particles and cellulose pulp. Upon subsequently encountering lower humidity, fiber-fiber and fiber-particle bonding is created resulting in increased web stiffness. The humidity-acquired stiffness was a significant impediment towards ambient inertness preferred of absorbent composites. The ambient susceptibility was reduced by (1) introducing filler, (2) lower neutralization of the absorbent fiber polymer, or (3) coating materials to the absorbent composite and/or superabsorbent entities. Experiments with talc provide preferred properties to a certain extent. Application of silicone-based oils and emulsions to the absorbent composite and/or to the superabsorbent entities provide substantially reduced ambient susceptibility.

EXAMPLE XII

Samples listed in Table 7 are absorbent structures prepared comprising superabsorbent fibers, cellulose wood pulp, sodium bicarbonate, and superabsorbent particles. For the superabsorbent fibers, an aqueous polymer solution included 24 percent by weight of a linear superabsorbent precursor prepared in the following manner. 670 grams of sodium hydroxide was dissolved in 22.1 kilograms of distilled water at ambient temperature in the 10 gallon Pfaudler reactor. To this solution 6.0 kilograms of Acrylic acid, 127 grams of 3-amino-1-propanol vinyl ether, and 17.5 grams of potassium persulfate were added and dissolved while the solution was mixed at ambient temperature. The solution was heated to 60 degrees centigrade during which time the polymerization was initiated. The reaction was completed after 5 hours. The solution then was removed from the reactor and solution spun into fibers using the process and equipment disclosed in the preferred embodiment of this patent. In the process of forming the superabsorbent fiber and prior to collecting the fibers on a moving foraminous surface, cellulose wood fibers, sodium bicarbonate, and superabsorbent particles are introduced into the superabsorbent fiber stream. The fluff used in these examples was CR1654. The wood fibers were fiberized into individual fibers using a hammer mill. The pulp fibers then were air conveyed through a rectangular duct and injected into the superabsorbent fiber stream. The superabsorbent particles and sodium bicarbonate were dry blended in the preferred weight ratios and introduced into the superabsorbent fiber stream by means of a christy particle feeder model 10 DE. The coform absorbent Nonmaterial was then densified by passing the material through a Repair of smooth calendar rolls. The gap between the rolls was Maladjusted to provide a final density of 0.3 gram per cubic centimeter. The coform material then was placed in ovens and heated cured for two hours at 130 degrees centigrade.

A number of coform absorbent composites formed having varying concentrations of wood pulp fluff, superabsorbent particles, sodium bicarbonate, and superabsorbent fibers were subjected to physical property testing. The components employed in forming the absorbent composites and their physical properties are set forth in Table 7.

TABLE 7

| Sample | Fluff wt. % | SAM part. wt. % | SAM fiber wt. % | NaHCO3 wt. % | SAM fiber type |
|---|---|---|---|---|---|
| 1 | 35 | 33 | 20 | 12 | A |
| 2 | 35 | 39 | 26 | 0 | A |
| 3 | 25 | 0 | 37.5 | 37.5 | A |
| 4 | 25 | 50 | 12.5 | 21.5 | A |
| 5 | 40 | 37 | 23 | 0 | A |
| 6 | 40 | 37 | 23 | 0 | B |

The addition of about 12 to 40 weight percent coformed superabsorbent fibers provides preferred vertical wicking height and wet/dry tensile strength over an air laid composite containing superabsorbent fiber as shown in example 6, a staple superabsorbent fiber, Oasis type 101, made by Allied Colloid Corporation.

EXAMPLE XIII

Material made from solution described in the Example I was evaluated. One material included ⅓ superabsorbent fibers (SAF) and ⅔ Coosa CR1654 pulp, and the other material included ⅔ superabsorbent fibers (SAF) and ⅓ Coosa CR1654 pulp. The materials were cured at two different temperatures for four different time periods. The curing profiles were done to prepare the samples for vertical wicking and absorbency testing as a function of curing time. The Saturated Capacity test was run on the materials to monitor absorbency. Permeability was done as a way to monitor degree of crosslinking also by curing time. Preferably, the permeability time in seconds was below 50 seconds. 100% superabsorbent fibers also were tested for Saturated capacity as a function of curing time. The results are shown in Tables 8, 9, and 10. Samples not cured long enough or at high enough temperature could not be tested for Vertical Wicking or Saturated Capacity due to the insufficient integrity. Under-curing also caused gel-blocking which affected permeability. The dashed line is shown for under-cured samples as well as others where no data was available.

Samples were densified using a Carver press with shims to obtain the required thickness.

TABLE 8

| ⅔ SAF ⅓ CR1654 | SAT CAP (g/g) | Permeability (sec) | Vert Wick as is (cm) | Vert Wick cm (dens. in g/cc) | Basis Wt. (gsm) of Vert. Wick. Samples |
|---|---|---|---|---|---|
| 140° C. 24 hr | — | — | — | — | — |
| 140° C. 48 hr | — | 291.1 | — | — | — |
| 140° C. 72 hr | — | 150.6 | 9 | 11 (.13) | 150 |
| 140° C. 96 hr | — | 42.9 | 10 | 11.25 (.14) | 120 |
| 150° C. 24 hr | 14.6 | 51.3 | 9.25 | 12.5 (.23) | 218 |
| 150° C. 48 hr | 13.7 | 20.2 | 11 | 13.75 (.14) | 115 |
| 150° C. 72 hr | 13.9 | 9.9 | 11.25 | 13.75 (.14) | 119 |
| 150° C. 96 hr | 12.9 | 16.5 | 12 | 13.75 (.14) | 137 |

TABLE 9

| ⅔ SAF ⅓ CR1654 | SAT CAP (g/g) | Permeability (sec) | Vert Wick as is (cm) | Vert Wick cm (dens. in g/cc) | Basis Wt. (gsm) of Vert. Wick. Samples |
|---|---|---|---|---|---|
| 140° C. 24 hr | — | — | — | — | — |
| 140° C. 48 hr | — | 55.3 | 8 | — | 277 |
| 140° C. 72 hr | — | 16.7 | 7.75 | 15 (.17) | 265 |
| 140° C. 96 hr | — | 13.9 | 8.25 | 14.75 (.17) | 249 |
| 150° C. 24 hr | 10.4 | 11.8 | 8 | 11 (.15) | 264 |
| 150° C. 48 hr | 11.2 | 11.7 | 8 | 13.25 (.17) | 290 |
| 150° C. 72 hr | 11.2 | 8.7 | 8.5 | 14 (.16) | 295 |
| 150° C. 96 hr | 10.9 | 7.7 | 8.25 | 16.5 (.15) | 264 |

TABLE 10

| ⅓ SAF ⅔ CR1654 | SAT CAP (g/g) |
|---|---|
| 150° C. 24 hr | 18.5 |
| 150° C. 48 hr | 17.8 |
| 150° C. 72 hr | 14.5 |
| 150° C. 96 hr | 15.4 |

EXAMPLE XIV

Material composed of ⅔ Superabsorbent fibers (SAF) and ⅓ CR1654 pulp was evaluated as well as material composed of ⅓ SAF, ⅓ CR1654, and ⅓ Favor 880 particulate superabsorbent. For clarification, the material composed of ⅔ SAF and ⅓ CR1654 was labeled as Code 1, and the material with ⅓ SAF, ⅓ CR1654, and ⅓ Favor 880 was labeled as Code 2. The codes were cured for shorter periods of time at a higher temperature (180° C.) and was done as a way of curing for shorter time periods. Permeability and SAT CAP were done as a way of determining the proper amount of curing. The results are shown in the Table 11.

TABLE 11

| Code 1 | SAT CAP (g/g) | Permeability (sec) |
|---|---|---|
| 180° C. 1.5 hr | — | 970 |
| 180° C. 2 hr | 15.4 | 713 |
| 180° C. 2.5 hr | 14.6 | 287 |
| 180° C. 3 hr | 14.6 | 108 |
| 130° C. 4 hr | 15.7 | 73 |
| 180° C. 5 hr | 15.6 | 45 |

Vertical Wicking was performed on Code 1 on material cured at 180° C. for 4 hours and 5 hours. A density profile was done on these samples. The results are shown in Table 12.

TABLE 12

| Code 1 press density (g/cc) | Vert Wick cm for 4 hr curing | Actual density for 4 hr curing (g/cc) | Vert Wick cm for 5 hr curing | Actual density for 5 hr curing (g/cc) |
|---|---|---|---|---|
| as is | 12 | 0.08 | 14.5 | 0.10 |
| 0.3 | 16.5 | 0.24 | 21.5 | 0.31 |
| 0.4 | 18.25 | 0.35 | 22.75 | 0.40 |
| 0.5 | 22 | 0.53 | — | — |

Vertical Wicking was performed on Code 2 cured at 180° C. for 4 hours. Permeability and SAT CAP also were done on an as is samples having no densification. The results are shown in Table 13.

TABLE 13

| Code 2 press density (g/cc) | Vert Wick cm for 4 hr curing | Actual density for 4 hr curing (g/cc) | Permeability (sec) | SAT CAP (g/g) |
|---|---|---|---|---|
| as is | 8.5 | 0.072 | 13.4 | 15.5 |
| 0.2 | 12 | 0.153 | — | — |
| 0.3 | 19 | 0.308 | — | — |
| 0.4 | 21 | 0.346 | — | 14.6 |

Discoloration and odor of samples occurred due to oxidation of pulp at these high temperatures for long periods of time.

Figure 7:
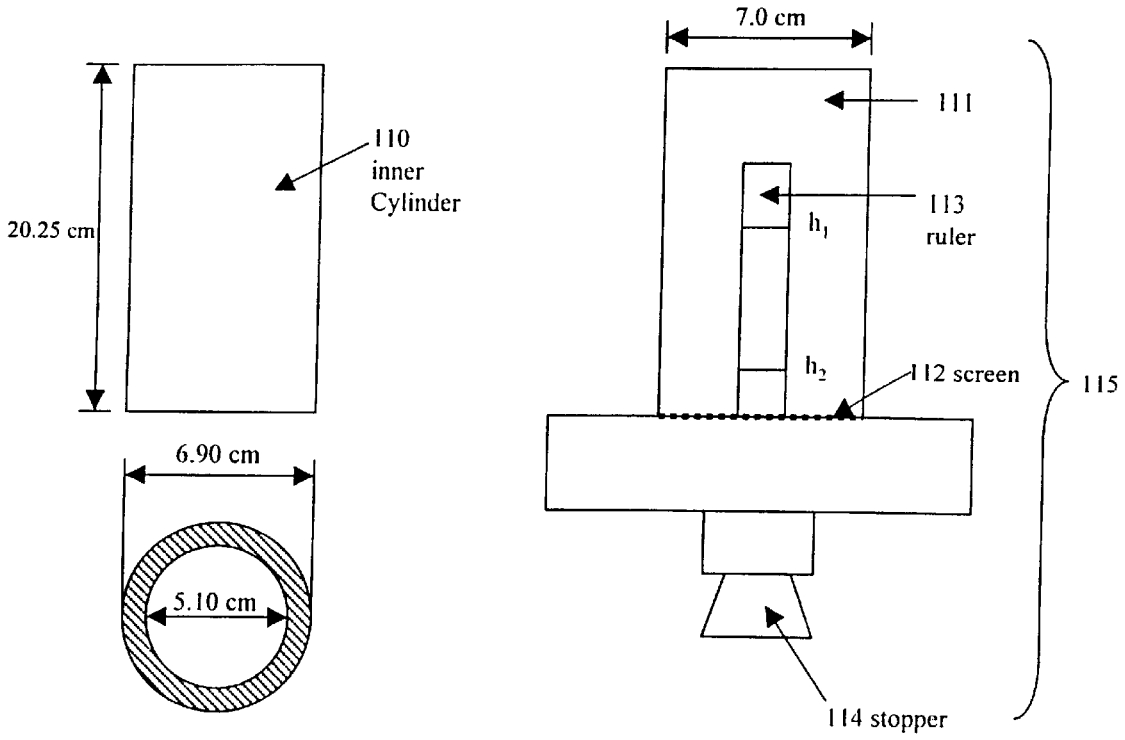
FIG. 7 is a schematic representation of a composite permeability test device.

A Composite Permeability Time test (FIG. 7) determined the permeability of a composite by recording the time for fluid to flow through a composite. FIG. 7 is a schematic representation of a composite permeability test device. A composite was die cut to the desired size. In this case, a 6.83 cm (2.69 inch) diameter circle was used. The composite was placed on the inner cylinder 110, and the outer cylinder (permeability tester) 111 was turned upside down over the inner cylinder with the composite, thereby ensuring that the composite rests neatly (with least amount of handling) on the screen 112 at the bottom of the test apparatus 115. The test fluid was poured in the inner cylinder on top of the composite. The fluid was above the top mark on the ruler (at least an inch) before starting the test. The sample was let to soak up the test fluid for 2 minutes. The test fluid was 0.9% w/v NaCi solution. To initiate the test, the stopper 114 was removed from the bottom of the permeability apparatus 115, and the timer was started when the fluid front reached the top mark on the ruler (6⅛" above the screen), and the timer was stopped when the fluid front reached the bottom mark on the ruler (1⅛" above the screen). Time in seconds was recorded. The permeability tester consisted of two plexiglass or polycarbonate concentric cylinders with one fitting inside the other with little clearance but still sliding freely. The inner cylinder 110 had an outer diameter of 6.9 cm and had an inner diameter of 5.10 cm. The outer cylinder 111 had an inner diameter of 7.0 cm and had a metal screen 112 attached to the bottom. The screen was a type 304 stainless steel screen with a hole diameter of 0.156 inches and 63% open area, 20 gauge, and 3/16 inch center to center spacing. A ruler 113 was on the outside of the outer cylinder 111 with height markings 6⅛" from the bottom of the screen 112 and 1⅛" from the bottom of the screen.

A Saturated Capacity Procedure test measured the capacity of a absorbent composite or product. The composite was cut to the preferred size and pressed to the preferred density. A dry weight of the composite as recorded. The composite was placed in 0.9% (w/v) NaCl solution for 20 minutes. The level of the NaCl solution was such that the composite was fully submerged. After 20 minutes, the composite was removed from the NaCl bath and placed horizontally on a screen to let drip for 1 minute. 0.5 psi pressure was applied evenly to the composite for 5 minutes. The wet weight of the composite was recorded. The calculation for saturated capacity was as shown in Equation 1.

$$SAT\ CAP\ (g/g) = \frac{(\text{wet weight (g)} - \text{dry weight (g)})}{(\text{dry weight (g)} - \text{nonabsorbent weight (g)})} \quad \text{(Eq. 1)}$$

The nonabsorbent weight has a value of zero for composites.

The Vertical Wicking Procedure test measured the absorbent potential of materials and products when all absorption occurs against gravity. Material was cut to the preferred size and pressed to the preferred density. ½" marks were drawn on the composite to track the height of the fluid front at preset time intervals determined by the tester (i.e., 10 sec, 30 sec, 60 sec, 90 sec, 2 min, 5 min, 10 min, 20 min, and 30 min). The test fluid was dyed so the fluid front could be seen in the test material.

Figure 8:
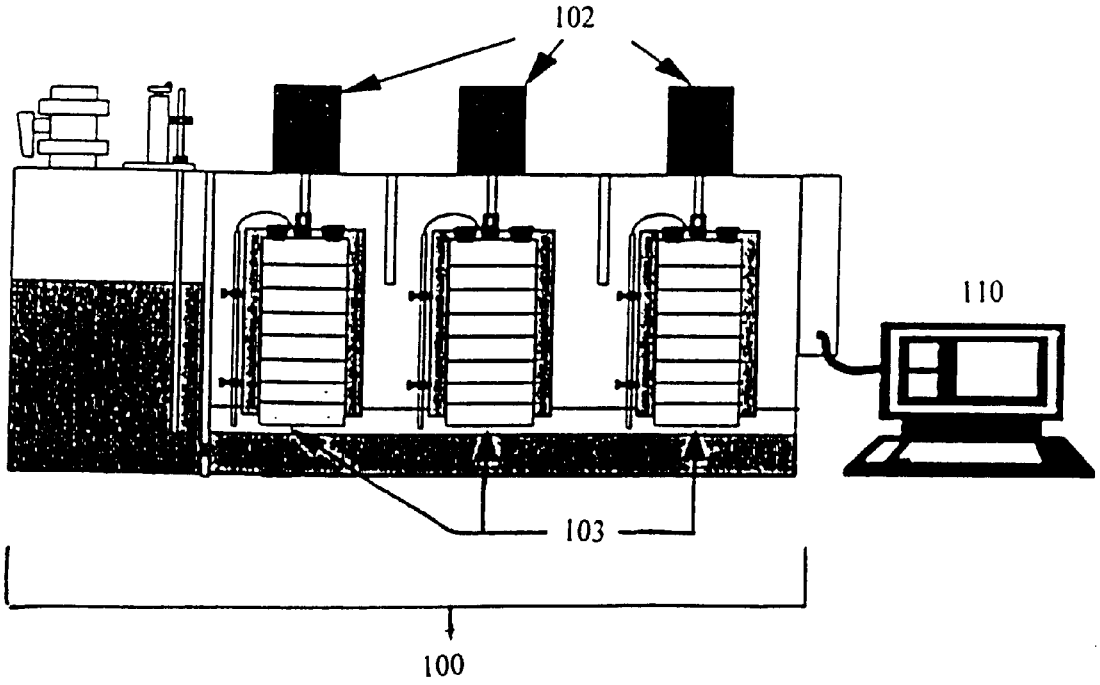
FIG. 8 is a schematic representation of a vertical wicking chamber test device.

FIG. 8 is a schematic representation of a vertical wicking chamber test device. FIG. 8 shows a wicking chamber 100 which was interfaced to a computer 110. This chamber had 3 sample holders 101 which were attached to strain gauges 102 which continually weighed the amount of fluid pickup with respect to time. The test material was placed on the sample holder 101 and hung vertically, such that when the test was initiated, about ⅛" of the composite was in the test fluid (reservoir). The test fluid used was 0.9% (w/v) NaCl solution. The sample holder included a sensor 103 so auto-initiation of the test could occur when the sensor came in contact with the test fluid. The height measurements were recorded by the tester. The test was run for a predetermined amount of time. In this case, a 30 minute test was done. Data obtained from this tests included fluid pickup amount and rate. Height that fluid front reached was only obtained from the tester.

The present invention also provides a novel nonwoven web and method of preparing a preferred nonwoven web including continuous superabsorbent fine fiber in which the primary gaseous source has a relative humidity of from about 60 to 95 percent, a temperature of from about 20° C. to about 100° C., a velocity of from about 30 to about 150 m/s, a horizontal angle of incidence of from about 70° to about 110°, and a vertical angle of incidence of no more than about 90°. The threadlines are dried to form fibers with a secondary gaseous source at a temperature of from about 140° C. to about 320° C. and having a velocity of from about 30 to about 150 m/s at a horizontal angle of incidence of from about 70° to about 110°, and a vertical angle of incidence of no more than about 90°. The fibers are deposited randomly on a moving foraminous surface to form a substantially uniform web on a scale of from about 1.9 to about 6.5 $cm^2$, the moving foraminous surface being from about 10 to about 100 cm from the opening from which the last gaseous source to contact the threadlines emerges, which fibers have a mean fiber diameter in the range of from about 10 to about 30 $\mu$m and are substantially uniform in diameter. The attenuating and drying steps are carried out under conditions of minimal macro scale turbulence.

The present invention further provides a novel nonwoven web and method of preparing a preferred continuous superabsorbent fine fibers and nonwoven web including these fibers in which the primary gaseous source has a relative humidity of from about 65 to 90 percent, a temperature of from about 20° C. to about 100° C., a velocity of less than about 30 m/s, a horizontal angle of incidence of from about 70° to about 110°, and a vertical angle of incidence of about 90°. The threadlines are dried to form fibers with a secondary gaseous source at a temperature of from about 140° C. to about 320° C. and having a velocity of less than about 30 30 m/s, a horizontal angle of incidence of from about 70° to about 110°, and a vertical angle of incidence of about 90°. The resulting fibers are attenuated with a tertiary gaseous source having a temperature of in the range of about 10° C. to about 50° C., a velocity in the range of about 30 to about 240 m/s, a horizontal angle of incidence of from about 70° to about 110°, and a vertical angle of incidence of no more than about 90°. The fibers are deposited randomly on a moving foraminous surface to form a substantially uniform web on a scale of from about 1.9 to about 6.5 $cm^2$, the moving foraminous surface being positioned at about 10 to about 100 cm from the opening from which the last gaseous source to contact the threadlines emerges, which fibers have a mean fiber diameter in the range of from about 10 to about 30 $\mu$m and are substantially uniform in diameter, in which the conditioning, drying, and attenuating steps are carried out under conditions of minimal macro scale turbulence.

The present invention also provides preferred substantially Continuous superabsorbent microfiber and a nonwoven web including these fibers, in which the fibers have a mean fiber diameter in the range of from about 0.1 to about 10 $\mu$m, are substantially free of shot, and are of a length such that they can be regarded as continuous in comparison with their diameters. The web is substantially uniform on a scale of from about 0.4 to about 1.9 $cm^2$, depending on the mean fiber diameter.

The present invention further provides a preferred nonwoven web including continuous superabsorbent fine fiber, in which the fibers have a mean fiber diameter in the range of from about 10 to about 100 $\mu$m, in which the fibers are essentially free of shot, and are substantially uniform in diameter; and the web is substantially uniform on a scale of from about 1.9 to about 6.5 $cm^2$, depending on the mean fiber diameter.

When high pressure humid air at pressure P1 Newton/$cm^2$, temperature T1 degrees C., and relative humidity RH1% is forced through an extremely narrow linear slot of Bo cm gap, the air is adiabatically expanded and cooled down into a high velocity jet stream of temperature T2, (i.e., T2<T1), pressure P2, relative humidity RH2 and velocity V2 m/min according to the thermodynamic principle. The jet momentum M2 Kg-m/secA2/cm then is 2 Bo V2 Rho2 V2, where Rho2 is the density of the jet air. The down-stream humidity RH2 is higher than the upstream RH1. The pressure P2 is kept at the atmospheric pressure. A solution blowing die of a linear row of small orifices of diameter Do provides the extruded solution threadlines of temperature Tt and concentration Ct are uniformly subject to the high velocity air stream, and then attenuated into finer threadlines by the resulting air drag force of the air stream. When the threadlines reach a preferred size Dt at a distance da from the orifice, the combined stream of the humid air and a curtain of wet attenuated threadlines is lasted with a secondary hot air jet of temperature Ta and velocity Va at an angle A with respect to the axis of the combined stream, removing the solvent water from the solution threadlines. In one aspect, additional multiple impingements of not drying air jets provide for more solvent evaporation. The dried threadlines then are laid down at a distance df from the die tip onto a foraminous moving wire under vacuum to obtain a randomly oriented non-woven web.

The impingement by hot drying air streams deflects and spreads the humidified jet, when these two momenta are comparable each other. The deflected combined jet stream entrains still room cooler air as a high momentum free jet. The deflected combined jet stream temperature then is reduced and its humidity becomes higher again. It is important to exhaust the cooler and wetter air immediately, e.g., through the forming wire. Depending on the permeability of the microfiber web, the vacuum under the wire is at 5–25 cm $H_2O$.

The removal of the solvent water from the wet threadlines occurs in an extremely short period of time, e.g., in a fraction of a second, while being attenuated into an extremely fine size. The simple and efficient process is controlled very carefully with respect to the complicated simultaneous heat, mass, and momentum transport. The degree of threadline attenuation increases with the increase of the drag force of the humid air jet, but with the decrease of the solution threadline viscosity u. The solution viscosity becomes low as the solution temperature becomes high or the concentration is low. It is important to maintain certain solution viscosity, i.e., solution concentration and temperature, at a given air drag force, i.e., the jet velocity, to achieve certain desired attenuation. When the wet threadlines of temperature Tt and concentration Ct are exposed to the humid air, the solvent evaporation rate is proportional to the difference of the equilibrium partial pressure exerted by the solution at Tt and Ct, and the partial pressure of water in the humid air, viz., the vapor pressure at T2 and P2 multiplied by RH2/100. No evaporation will occur if the two pressures are the same. When they are very different, and when solvent evaporation is very high, on the other hand, the solution viscosity of the threadlines become so high, and so is the resulting stress in the threadlines. The elongational stress increases beyond the cohesive force of the solution, eventually breaking threadlines and globbing around the die orifice. The broken lines yield large solution globs, spits, or shots in the web. Similar shots occur because of the capillary failure compared with the cohesive failure, when the solution viscosity is too low, when threadlines are so fine, and/or when the solution surface tension is too high. A proper control of the threadline solution rheology via proper control of the surrounding air environment, viz., humidity, temperature, and velocity, up to the distance da, is critical to obtain preferred fine fibers.

At the end of the evaporation delayed zone, two hot air jets preferably are let blast the humid air stream, preferably one at a time in order to remove quickly the solvent water from the attenuated fine threadlines. The first jet preferably impinges the humid air stream at a certain angle A<90 degrees and with the jet momentum comparable to that of the air stream so as for the combined air stream to be noticeably deflected. The attenuated wet threadlines see the hot dry air immediately, enhancing the convective solvent evaporation. But special caution is made so that this hot air jet may not disrupt the gentle humid air attenuation in the upstream, which happens when the impingement single A>90 degrees and/or when the hot air momentum is too large. The resulting combined air stream is layered at the beginning with hot air and humid air layers. The two layers then are diffused one with the other. Since the diffusion process is slow, a second hot air jet blasted the combined air stream, promoting the turbulent mixing instead of diffusional mixing, and thereby accelerating the solvent evaporation. A simultaneous impingement of the two hot air disrupts the gentle attenuation process. The two high velocity hot airs also contribute their momenta to the drag force of the humid air. A delicate balance is made not to break the threadlines. In one aspect, the three jet impingement is arranged for air dragging mainly by the hot air jets.

EXAMPLE XV

In order to demonstrate the need of the proper control of threadline attenuation and solvent removal, the following series of experiments were carried out. The condition of the humid air expanded through the air gap was controlled as follows. A compressed hot air was blended with a cold compressed air to obtain a certain air temperature with fine needle valves, and the resulting warm air then was blended with a steam to obtain a desired relative humidity and temperature. Any condensed water, which occurs during this mixing process, was removed with a combination of steam separator and trap. The "dry" humid air was fed into a manifold of a six inch wide solution blowing die at a certain desired pressure P1 through a pressure controller. The pressure mainly determines the momentum of the humid air jet along with the air gap. The gaps were set at 0.034 inches and were flat, i.e., not stuck-out nor recessed. The die tip was flush with the air plate tips.

A computer thermodynamic program was made to control the Uncomplicated system to obtain certain desired humid air environment after expansion through the air gap. The calculated condition was checked out in an experiment in which no solution is Extruded, nor hot airs blasted the humid air stream.

Solution was extruded through the die with hot drying airs on under certain controlled humid air conditions. Then, solution spinnability and threadline drying were observed. The die tip was 120 holes ×0.0381 cm diameter orifices over 15.2 cm width, and a 25% solid solution was extruded at a rate of 38 g/min and 77° C. The first hot drying air was impinged onto the controlled humid air from one side at an angle of approximately 56 degrees with respect to the axis of the humid air jet close to the tip of the humid air plate at a rate of approximately 0.33 $m^3$/cm through the 0.348 cm gap nozzle. The air volumetric flow rate was measured at 21° C. and atmospheric pressure. The air temperature at the outlet of the nozzle was approximately 260° C. The second hot drying air jet then was impinged onto the combined air stream at a short distance away, e.g., approximately 6.4 cm from the outside of the air plate, at an angle of 40–50 degrees from the humid air jet axis. The temperature and rate of the hot air was approximately 316° C. and 0.33 $m^3$/cm, respectively. The nozzle gap was 0.185 cm. The moving forming wire was located at a distance of 56 cm from the die tip to collect the dried microfibers under vacuum of 15.2 cm $H_2O$ at 0.46 m/min. The collected web was spread to approximately 51 cm, and its basis weight was 40 g/$m^2$.

Characteristics of microfiber forming and drying were observed under various humid air conditions around the die tip. When the extruded solution threadlines were attenuated well without breakage, they looked very steady. Otherwise, the threadlines looked to be flickering and globbing up around the die tip in the worst case. When drying was not sufficient, the collected web appeared wet in the middle, and even mottled in the worst case. When the humid air momentum was too low, i.e., at too low P1, the two hot drying airs overwhelmed the jet and threadlines could not be formed at all. At a certain value of the momentum (P1=2.8 Newton/

$cm^2$), preferred forming and drying was observed in a range of relative humidity values particularly at lower temperature T2. The humidity range appeared wider when the Momentum was higher.

EXAMPLE XVI

The polymer solution prepared in Example I was used. Non-woven webs were produced on an apparatus having a 15.2 cm wide die having 120 orifices (11.8 orifices per cm). Each orifice had a diameter of 0.46 mm. The die was constructed as described in U.S. Pat. Nos. 3,755,527, 3,795,571, and 3,849,241, each of which is incorporated herein by reference. The primary gaseous source was divided into two streams, the exits of which were located parallel with and closely adjacent to the row of extrusion orifices. Each primary gaseous stream exit was about 0.86 mm in width. The ducts leading to the two primary gaseous stream exits were at an angle of 30° from the vertical, i.e., the plane in which the centers of the extrusion orifices were located. The vertical angles of incidence for the two primary gaseous streams were 30° and −30°, respectively. The absolute value of the vertical angle of incidence for each of the two primary gaseous streams was 300. The horizontal angle of incidence for each primary gaseous stream was 90°.

The secondary gaseous source also was divided into two secondary gaseous streams. The first secondary gaseous stream was introduced on the back side of the threadline curtain. The vertical angle of incidence for the first secondary gaseous stream was −30°. The horizontal angle of incidence was 900. The exit of the first secondary gaseous stream was located 5 cm below the die tip and 2.5 cm from the threadline curtain.

The second secondary gaseous stream was introduced on the front side of the threadline curtain. The vertical angle of incidence for the second secondary gaseous stream was 0°, and the horizontal angle of incidence was 90°. The second secondary gaseous stream exited the secondary gaseous stream conduit parallel with the threadline curtain. The exit of the second secondary gaseous stream was located 5 cm below the die tip and 10 cm from the threadline curtain.

The moving foraminous surface was located 22–76 cm below the secondary gaseous source exits which were approximately equal distances below the die tip. A vacuum of 2–6 inches (0.005–0.015 atm) water was maintained under the wire.

The sodium polyacrylic acid copolymer solution of Example XV (26% solids) was heated in a two-liter Buchi autoclave at 50° C. under air pressure at 80 psig (5.4 atm).

The solution was pumped by means of a Zenith metering pump to the die through a transfer line heated at 82° C. The solution D was extruded at about 82° C. The primary gaseous source was hot humidified air at a temperature of approximately 93° C., 79% RH, and a pressure of 6 psig (0.41 atm) before the outlet of the primary air gap. The secondary gaseous source was compressed air heated to a temperature of 260°–316° C. The flow rate was 300–400 cfm (42.5–61.4 liters per second). The die tip temperature was maintained at 82° C., and the extrusion rate was 0.33–0.83 g per minute per orifice.

Four different solutions extrusion rates, 0.33, 0.55, 0.67, and 0.83 g per min, were employed to form non-woven webs. The basis weight for each web produced ranged from 34 to 38 g per square meter. Fiber size distribution measurements were made on these four webs by measuring the diameter of each fiber which crossed an arbitrary straight line drawn on a typical scanning electron micrograph and typically required measuring the diameters of 50 fibers.

The tensile properties of the non-woven webs obtained were measured in accordance with standard test procedures, Federal Standard 191A, Method 5102.

EXAMPLE XVII 5.9 kg of acrylic acid, 2.29 kg of sodium hydroxide, 143 g of 3-amino-1-propanol vinyl ether, and 11.97 gram of potassium persulfate, all available from Aldrich Chemical Company, were added into the 10 gallon jacketed Pfaudler reactor containing 21.78 kg of distilled water and equipped with an agitator. The added components were mixed at room temperature to form a completely dissolved solution. The reactor then was heated to 60° C. for four hours. The agitator was on continuously. The formed polyacrylic acid sodium salt solution includes 73.8% by weight of sodium acrylate, 24.2% by weight of acrylic acid, and 2% by weight of 3-amino-1-propanol vinyl ether.

EXAMPLE XVIII

The polymer solution prepared in Example XVII was used to prepare nonwoven webs on an apparatus having a six-inch (15.2-cm) wide die having 120 orifices (20 orifices per inch or about 11.8 orifices per cm). Each orifice had a diameter of 0.46 mm. The die was constructed essentially as described in U.S. Pat. Nos. 3,755,527, 3,795,571, and 3,849,241, each of which is incorporated herein by reference. The primary gaseous source was divided into two streams, the exits of which were located parallel with and closely adjacent to the row of extrusion orifices. Each primary gaseous stream exit was about 0.86 mm in width. The ducts leading to the two primary gaseous stream exits were at an Angle of 30° from the vertical, i.e., the plane in which the Reenters of the extrusion orifices were located. Thus, the vertical angles of incidence for the two primary gaseous streams were 30° and −30°, respectively. The absolute value of the Vertical angle of incidence for each of the two primary gaseous streams was 30°. The horizontal angle of incidence for each primary gaseous stream was 90°.

The secondary gaseous source also was divided into two secondary gaseous streams. The first secondary gaseous stream was introduced on the back side of the threadline curtain. The vertical angle of incidence for the first secondary gaseous stream was −30°. The horizontal angle of incidence was 90°. The exit of the first secondary gaseous stream was located about 5 cm below the die tip and about 2.5 cm from the threadline curtain.

The second secondary gaseous stream was introduced on the front side of the threadline curtain. The vertical angle of incidence for the second secondary gaseous stream was about 0° and the horizontal angle of incidence was 90°. Thus, the second secondary gaseous stream exited the secondary gaseous stream conduit approximately parallel with the threadline curtain. The exit of the second secondary gaseous stream was located about 5 cm below the die tip and about 10 cm from the threadline curtain. The moving foraminous surface was located roughly 22–76 cm below the secondary gaseous source exits which were approximately equal distances below the die tip. A vacuum of 2–6 inches (0.005–0.015 atm) water was maintained under the wire.

The sodium polyacrylic acid copolymer solution of Example I (26% solids) was heated in a two-liter Buchi autoclave at 50° C. under air pressure at 80 psig (5.4 atm).

The solution was pumped by means of a Zenith metering pump to the die through a transfer line heated at about 82° C. The solution was extruded at about 82° C. The primary gaseous source was hot humidified air at a temperature of approximately 93° C., 79% RH and a pressure of 6 psig (0.41 atm) before the outlet of the primary air gap. The secondary gaseous source was compressed-air heated to a temperature of 260°–316° C.; the flow rate was 300–400 cfm (42.5–61.4 liters per second). The die tip temperature was maintained at 82° C., and the extrusion rate was 0.33–0.83 g per minute per orifice.

Four different solutions extrusion rates, 0.33, 0.55, 0.67, and 0.83 g per min, were employed to form nonwoven webs. The basis weight for each web produced ranged from 34 to 38 g per square meter. Fiber size distribution measurements were made on these four webs. The fiber size distribution measurements involved measuring the diameter of each fiber which crossed an arbitrary straight line drawn on a scanning electron micrograph and typically required measuring the diameters of 50 fibers. The results of such measurements are summarized in Table 14.

TABLE 14

| | Fiber Diameter Distribution | | | |
|---|---|---|---|---|
| | % Frequency | | | |
| Web Number | 1 | 2 | 3 | 4 |
| Throughput (gpm) | 100 | 80 | 60 | 40 |
| Fiber size (μm) | | | | |
| 1.5 | 0 | 0 | 4 | 4 |
| 2 | 0 | 0 | 6 | 8 |
| 2.5 | 0 | 0 | 2 | 18 |
| 3 | 0 | 0 | 10 | 4 |
| 3.5 | 6 | 2 | 4 | 18 |
| 4 | 10 | 6 | 6 | 2 |
| 4.5 | 8 | 16 | 6 | 6 |
| 5 | 16 | 18 | 6 | 6 |
| 5.5 | 6 | 4 | 4 | 6 |
| 6 | 16 | 12 | 14 | 8 |
| 6.5 | 8 | 16 | 12 | 10 |
| 7 | 0 | 2 | 2 | 2 |
| 7.5 | 8 | 12 | 4 | 2 |
| 8 | 8 | 4 | 2 | 0 |
| 8.5 | 0 | 6 | 12 | 4 |
| 9 | 2 | 0 | 0 | 2 |
| 9.5 | 6 | 0 | 0 | 0 |
| 10 | 2 | 2 | 0 | 0 |
| 10.5 | 2 | 0 | 2 | 0 |
| 11 | 0 | 2 | 0 | 0 |
| 11.5 | 0 | 0 | 0 | 0 |
| 12 | 0 | 0 | 2 | 0 |
| More | 2 | 0 | 2 | 0 |
| AVERAGE | 6.015 | 5.8308 | 5.3928 | 4.1154 |
| STD DEV | 2.06286 | 1.608323 | 2.53919 | 1.987291 |

The data from Table 14 were plotted as frequency versus fiber diameter in μm to aid in the visualization of the fiber diameter frequencies.

The tensile properties of the nonwoven webs obtained were measured in accordance with standard test procedures, Federal Standard 191A, Method 5102. The strip tensile procedure gave results for peak load, percent elongation, and energy.

The tensile characteristics of the nonwoven webs were obtained. All reported values were normalized to allow for differences in basis weights.

To assist in the visualization of the tensile characteristics data, the data were plotted as bar graphs, with separate bars for MD data, CD data, and the average of the MD and CD data, respectively.

EXAMPLE XIX

In order to prepare a coformed web, the procedure of Example XVIII was essentially repeated. A largely softwood pulp sheet (Coosa CR-54, manufactured by Kimberly-Clark Corporation at its Coosa Pines, Ala., Mill) was fiberized with a hammer mill and then blown with air at a velocity of 83 m/s through a rectangular duct having a depth of 2.5 cm. The dilution rate, defined as g of fiberized pulp per cubic meter of carrier air volume, was kept in the range of from about 2.8 to about 8.5 to minimize flocculation. The resulting air-borne fiber stream then was injected into the threadline-carrying first secondary gaseous stream at the region where the threadline-carrying first secondary gaseous stream and second secondary gaseous stream met. Both the vertical and horizontal angles of incidence of the air-borne fiber stream were about 90°. The stream exited the rectangular duct about 10 cm from the region where the two secondary gaseous The process of the present invention is capable of modifications and variations without departing from the scope thereof. Accordingly, the detailed description and examples set forth above are meant to be illustrative only and are not intended to limit the scope of the invention as set forth in the appended claims. streams met.

In each case, the resulting coformed web was well integrated and strong, but soft, bulky, and absorbent. The web was composed of 50–70 percent by weight of pulp fibers and had a basis weight of about 500 g/m$^2$. Even after heat treatment in a convection oven to cross link sodium polyacrylic acid copolymer, these webs were very soft, absorbent and of reasonable mechanical strength as shown in Table 15. Such coformed webs are useful as wipes or as components of other absorbent products.

TABLE 15

| | Peak Tensile Property | | | |
|---|---|---|---|---|
| | Web Number | | | |
| | 1 | 2 | 3 | 4 |
| SAF Comp (%) | 71 | 66 | 60 | 50 |
| Load (m) | 392 | 349 | 424 | 406 |
| Strain (%) | 11.9 | 14.0 | 16.6 | 9.5 |
| Energy (m) | 2.59 | 3.04 | 4.25 | 2.40 |

EXAMPLE XX

In this example, in addition to Coosa pulp, superabsorbent powder (Favor 880 from Stockhausen, Inc.) was introduced into the pulp stream prior to its meeting the threadline-carrying first secondary gaseous stream. The composition was about 33% superabsorbent fiber, 33% pulp, and 34% superabsorbent powder. The total basis weight was measured. This material was quite soft after been made. In 30 minutes, it wicked 0.9% NaCl water solution to about 23 cm.

EXAMPLE XXI

This example is similar to Example XX, with the exception of material composition. A nonwoven coform web was successfully made with about 3% superabsorbent fiber, 3% Coosa pulp, and about 94% superabsorbent powder (Favor 880 from Stockhausen, Inc.). The material had excellent SAM superabsorbent material containment capability since fair amount of superabsorbent powder particles were adhered to the superabsorbent fibers.

EXAMPLE XXII

This Example is similar to Example XVIII, with the exception that the relative humidity of the primary gaseous stream was varied. As determined from SEM, satisfactory results were achieved only when the relative humidity level is in the range of 30% to 100%.

The process of the present invention is capable of modifications and variations without departing from the scope thereof. Accordingly, the detailed description and examples set forth above are meant to be illustrative only and are not intended to limit the scope of the invention as set forth in the appended claims.

What is claimed is:

1. A nonwoven web of substantially continuous synthetic microfiber, comprising:

a. a nonwoven web containing substantially continuous synthetic amide crosslinked microfiber, said synthetic amide crosslinked microfiber having a fluid absorbency under load at a level of 10 grams of 0.9% by wt. aqueous sodium chloride per gram of dry absorbent fiber; and b. said fibers having a mean fiber diameter in the range of from about 0.1 to about 10 $\mu$m, being substantially free of shot, and being of a length such that they can be regarded as continuous in comparison with their diameters.

2. A nonwoven web of substantially continuous synthetic microfiber according to claim 1, formed by preparing an aqueous polymer solution of about 10 to about 75 percent by weight of a linear synthetic amide crosslinked precursor polymer having a molecular weight of from about 300,000 to about 10,000,000; extruding said polymer solution at a temperature of from about 20° C. to about 180° C. and a viscosity of from about 3 to about 1000 Pa sec through a die having a plurality of orifices to form a plurality of threadlines, said orifices having diameters in the range of from about 0.20 to about 1.2 mm; and attenuating said threadlines with a primary gaseous source under conditions sufficient to permit the viscosity of each threadline, as it leaves a die orifice to increase incrementally with increasing distance from the die, while substantially maintaining uniformity of viscosity in the radial direction, at a rate sufficient to provide fibers having the desired attenuation and mean fiber diameter without significant fiber breakage.

3. A nonwoven web of substantially continuous synthetic microfiber according to claim 2, wherein said web is substantially uniform on a scale of from about 0.4 to about 1.9 $cm^2$, depending on the mean fiber diameter.

4. A nonwoven web of substantially continuous synthetic microfiber, comprising:

a. a nonwoven web containing substantially continuous synthetic amide crosslinked microfiber, said synthetic microfiber having a fluid absorbency under load at a level of 10 grams of 0.9% by wt. aqueous sodium chloride per gram of dry absorbent fiber; and b. said fibers having a mean fiber diameter in the range of from about 10 to about 100 $\mu$m, being substantially free of shot, and being substantially uniform in diameter.

5. A nonwoven web of substantially continuous synthetic microfiber according to claim 4, formed by preparing an aqueous amide crosslinked polymer solution of about 10 to about 75 percent by weight of a linear synthetic precursor polymer having a molecular weight of from about 300,000 to about 10,000,000; extruding said polymer solution at a temperature of from about 20° C. to about 180° C. and a viscosity of from about 3 to about 1000 Pa sec through a die having a plurality of orifices to form a plurality of threadlines, said orifices having diameters in the range of from about 0.20 to about 1.2 mm; and attenuating said threadlines with a primary gaseous source under conditions sufficient to permit the viscosity of each threadline, as it leaves a die orifice to increase incrementally with increasing distance from the die, while substantially maintaining uniformity of viscosity in the radial direction, at a rate sufficient to provide fibers having the desired attenuation and mean fiber diameter without significant fiber breakage.

6. A nonwoven web of substantially continuous synthetic microfiber according to claim 5, wherein said web is substantially uniform on a scale of from about 1.9 to about 6.5 $cm^2$, depending on the mean fiber diameter.

7. A disposable absorbent product incorporating a nonwoven web of substantially continuous synthetic microfiber according to claim 4.

8. A disposable absorbent product according to claim 7 formed to provide a disposable absorbent article selected from the group consisting of diapers, training pants, catamenial devices, sanitary napkins, tampons, incontinent products and wipes.

9. A disposable absorbent product incorporating a nonwoven web of substantially continuous synthetic microfiber according to claim 6.

10. A disposable absorbent product according to claim 9, formed to provide a disposable absorbent article selected from the group consisting of diapers, training pants, incontinent products, and tissue wipes.

11. A disposable absorbent product according to claim 9 formed to provide a disposable absorbent article selected from the group consisting of catamenial devices, sanitary napkins, and tampons.

* * * * *